US007708169B1

(12) United States Patent
Szoke, Jr.

(10) Patent No.: US 7,708,169 B1
(45) Date of Patent: May 4, 2010

(54) COMPACT POWERED CAULKING GUN WITH SCISSOR TYPE DISPENSING MECHANISM

(76) Inventor: Anthony A. Szoke, Jr., 523 Cedar St., West Hempstead, NY (US) 11552

( * ) Notice: Subject to any disclaimer, the term of this patent is extended or adjusted under 35 U.S.C. 154(b) by 592 days.

(21) Appl. No.: 11/604,515

(22) Filed: Nov. 27, 2006

(51) Int. Cl.
*B05C 17/005* (2006.01)
*B05C 17/01* (2006.01)

(52) U.S. Cl. ..... 222/326; 222/327; 222/333; 222/390; 222/467

(58) Field of Classification Search ..... 222/30, 222/37, 41, 325–327, 333, 386, 390, 467
See application file for complete search history.

(56) References Cited

U.S. PATENT DOCUMENTS 1,904,364 A * 4/1933 Fullmer ..... 401/60
4,157,771 A * 6/1979 Smith ..... 222/390
4,634,431 A * 1/1987 Whitney et al. ..... 222/333
4,991,743 A * 2/1991 Walker ..... 222/386.5
5,052,593 A * 10/1991 Grome et al. ..... 222/333
5,503,307 A 4/1996 Wilson et al.
6,056,165 A * 5/2000 Speranza ..... 222/333
6,321,945 B1 11/2001 Girouard et al.
6,460,481 B1 * 10/2002 Young ..... 222/327
6,540,113 B2 * 4/2003 Gardos ..... 222/326
6,626,329 B2 * 9/2003 Rake et al. ..... 222/103
6,743,205 B2 * 6/2004 Nolan et al. ..... 604/154
2002/0108971 A1 8/2002 Lafond

* cited by examiner

*Primary Examiner*—Kenneth Bomberg

(57) ABSTRACT

Compact powered caulking gun comprising of a body consisting of two clamshells. A removable cartridge cradle with a three position, rheostatic extrusion speed regulator, Forward-On, Off, Reverse-On switch attached to the body. A motor operatively coupled to an actuator shaft with two oppositely pitched threads thereon. An upper link member actuator with a pitched thread formed therewithin, rotatably situated on the actuator shaft. A lower link member actuator with a pitched thread formed therewithin, rotatably situated on the actuator shaft. A scissor-type mechanism, with a pusher plate, operatively connected to the upper link member actuator and operatively connected to the lower link member actuator for the purpose of dispensing caulk, adhesive and other viscous materials.

3 Claims, 22 Drawing Sheets

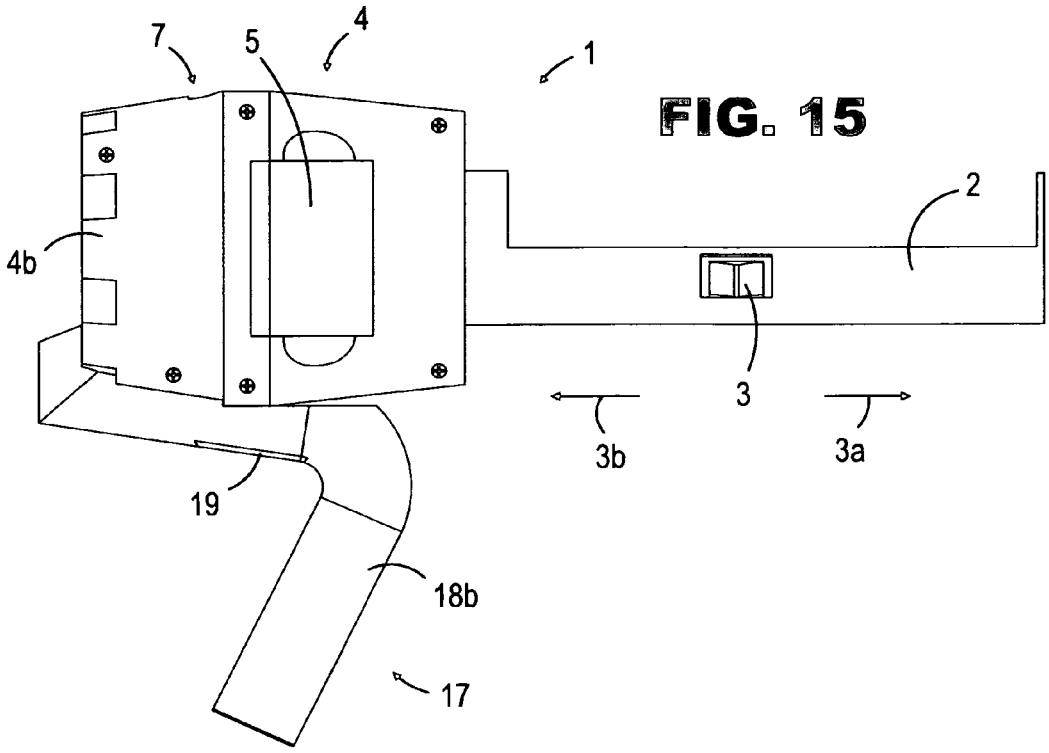
FIG. 15
FIG. 16
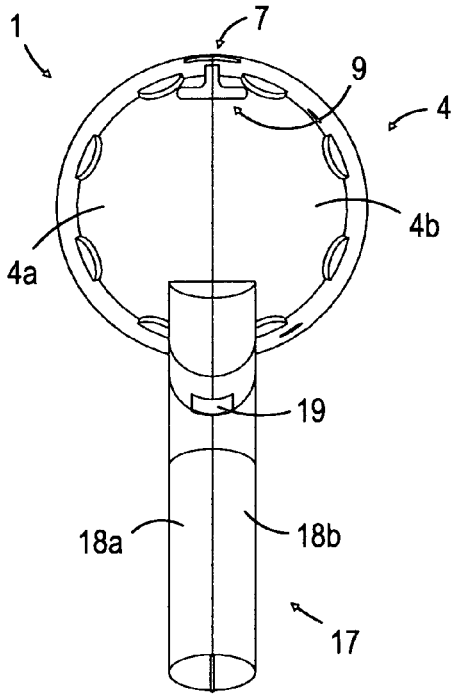
FIG. 17
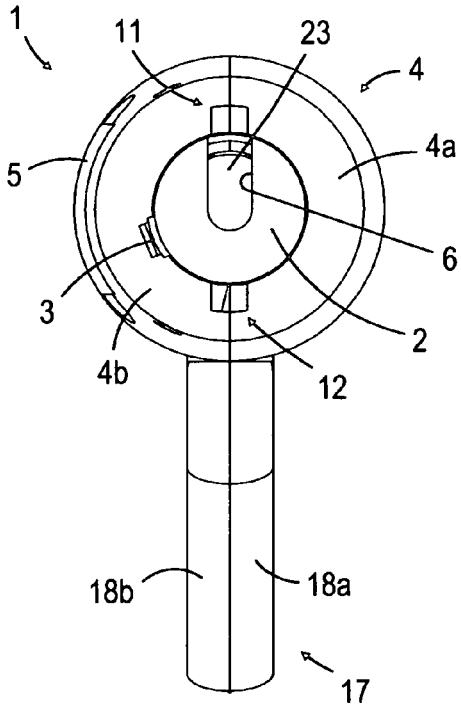

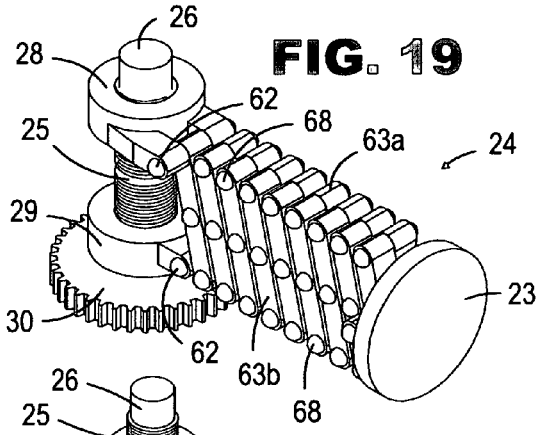
FIG. 19
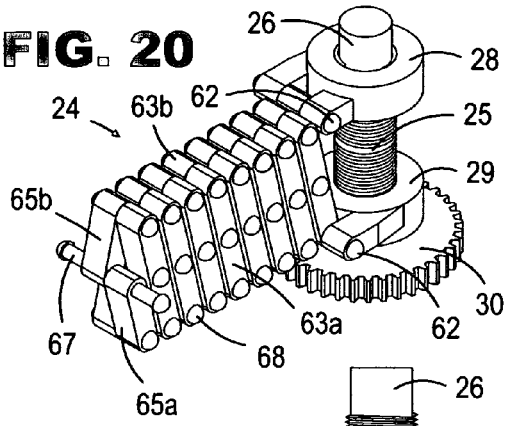
FIG. 20
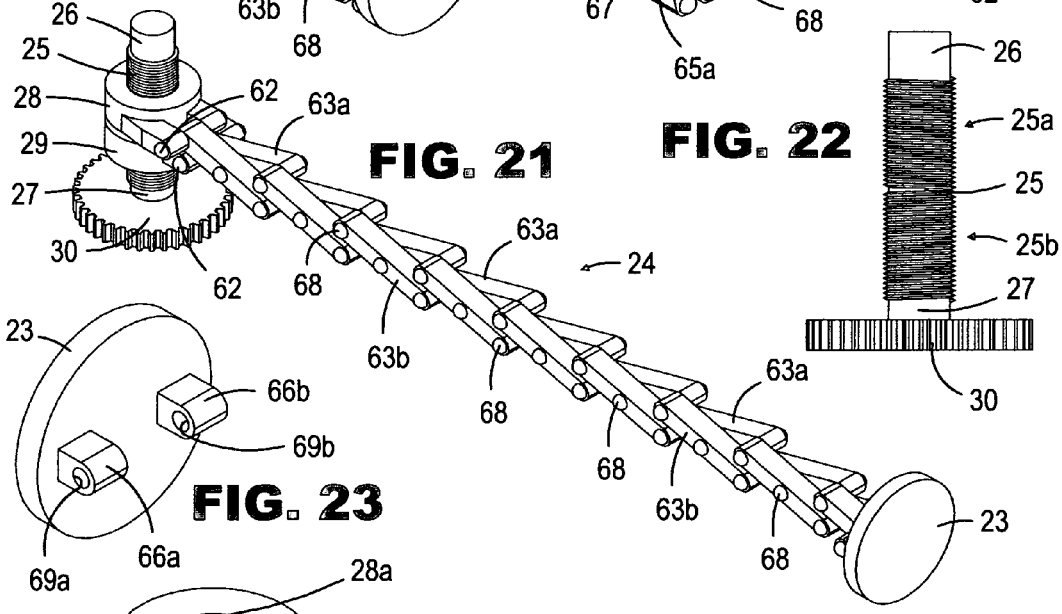
FIG. 21
FIG. 22
FIG. 23
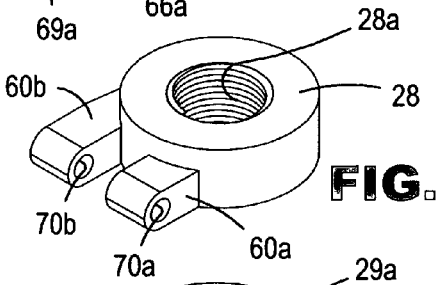
FIG. 24
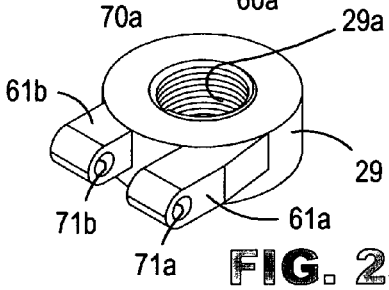
FIG. 25
FIG. 26
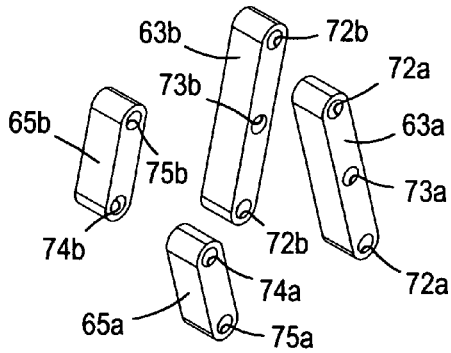

COMPACT POWERED CAULKING GUN WITH SCISSOR TYPE DISPENSING MECHANISM

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to motor driven caulking gun and the like for dispensing caulk, adhesive and other viscous materials.

There have been attempts in the past to invent a compact motor driven caulking gun that does not have a plunger rod protruding at the back of the motor driven caulking gun. Examples of such caulking guns are shown in U.S. Pat. No. 5,503,307, invented by Steven J. Wilson and John H. Klock; and U.S. Pat. No. 6,321,945, invented by Gaston Girouard and Elinor Girouard; and U.S. Pat. Application No. US 2002/0108971 A1, invented by Luc Lafond. Unfortunately, all these inventions have their inherent impractical drawbacks. Additionally each of the aforementioned patents possesses a bulky handle, which sometimes can be in the way when applying caulk in tight spaces.

BRIEF SUMMARY OF THE INVENTION

It is an object of the present invention to provide a relatively compact caulking gun that can be easily manipulated with only one hand if required while dispensing caulk, adhesive and other viscous materials.

The preferred embodiments of the compact powered caulking gun comprises of a body consisting of two clamshells, with a plurality of electrical contacts incorporated into one of the clamshells. A removable cartridge cradle with a three position, rheostatic extrusion speed regulator, Forward-On, Off, Reverse-On switch attached to the body. The removable cartridge cradle having a plurality of embedded electrical terminals connected to a plurality of insulated electrical wires embedded and connected to the three position, rheostatic extrusion speed regulator, Forward-On, Off, Reverse-On switch. A motor electrically connected via the electrical contacts to the three position, rheostatic extrusion speed regulator, Forward-On, Off, Reverse-On switch. A battery electrically connected via the electrical contacts to the three position, rheostatic extrusion speed regulator, Forward-On, Off, Reverse-On switch. Two Cut-Off switches are electrically connected via the electrical contacts to the three position, rheostatic extrusion speed regulator, Forward-On, Off, Reverse-On switch. The motor operatively coupled to an actuator shaft with two oppositely pitched threads thereon. An upper link member actuator with a pitched thread formed therewithin, rotatably situated on the actuator shaft. A lower link member actuator with a pitched thread formed therewithin, rotatably situated on the actuator shaft. A scissor-type mechanism, with a pusher plate, operatively connected to the upper link member actuator and operatively connected to the lower link member actuator.

An optional attachable, detachable rear handle and an optional attachable, detachable gun-type handle are provided to the operator if so desired.

BRIEF DESCRIPTION OF THE SEVERAL VIEWS OF THE DRAWING

FIG. 15 is a side elevation view of the compact powered caulking gun with the optional gun-type handle attached.

FIG. 16 is a rear elevation view of the compact powered caulking gun with the optional gun-type handle attached.

FIG. 17 is a front elevation view of the compact powered caulking gun with the optional gun-type handle attached.

FIG. 19 is a front perspective view of the scissor-type mechanism in the retracted position.

FIG. 20 is another front perspective view of the scissor-type mechanism in the retracted position.

FIG. 21 is a front perspective view of the scissor-type mechanism in the extended position.

FIG. 22 is a side elevation view of the actuator shaft.

FIG. 23 is a rear perspective view of the pusher plate.

FIG. 24 is a front perspective view of the upper link member actuator.

FIG. 25 is a front perspective view of the lower link member actuator.

FIG. 26 is a perspective view of the link members.

DETAILED DESCRIPTION OF THE INVENTION

Figure 1:
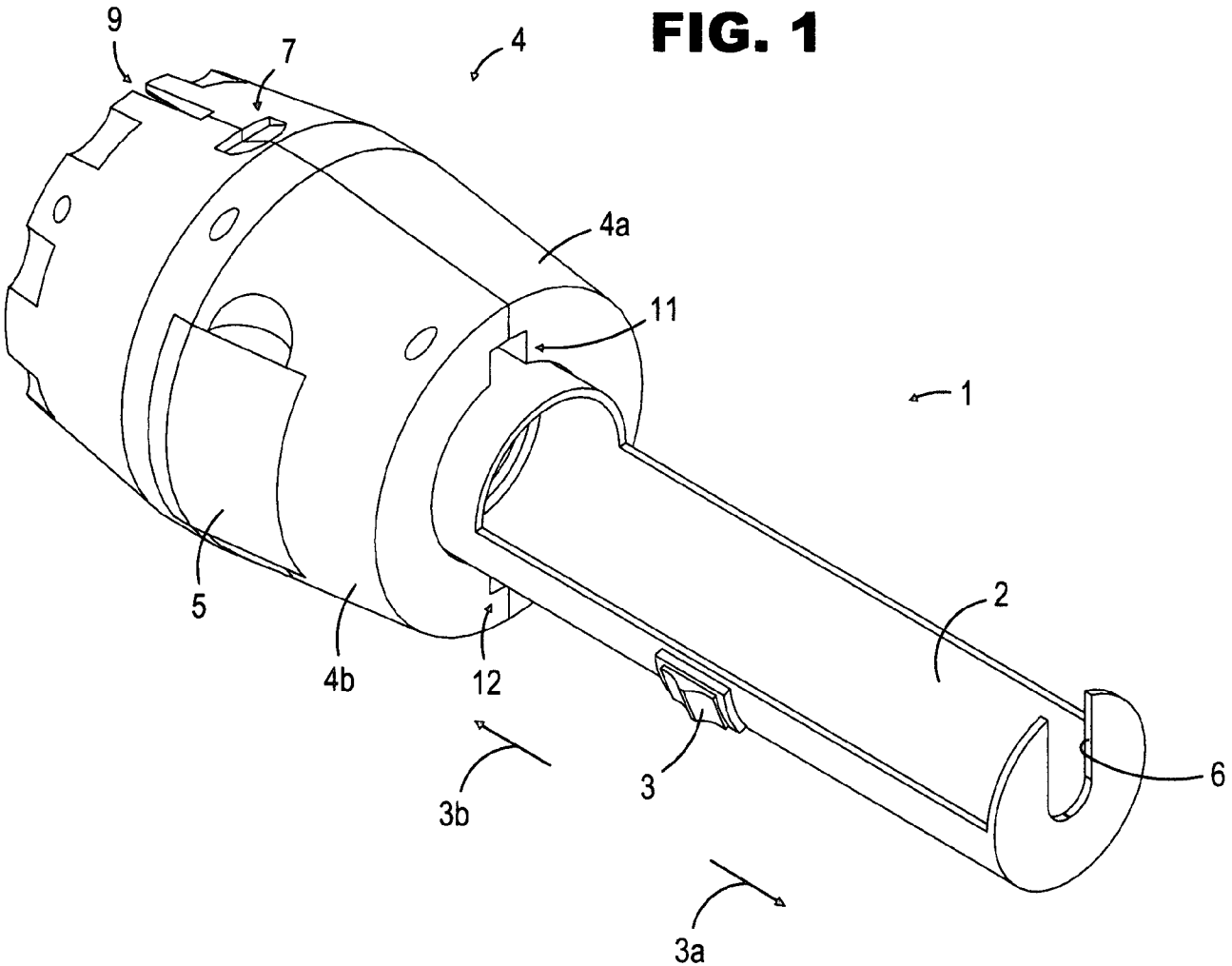
FIG. 1 is a front perspective view of the compact powered caulking gun.
Figure 2:
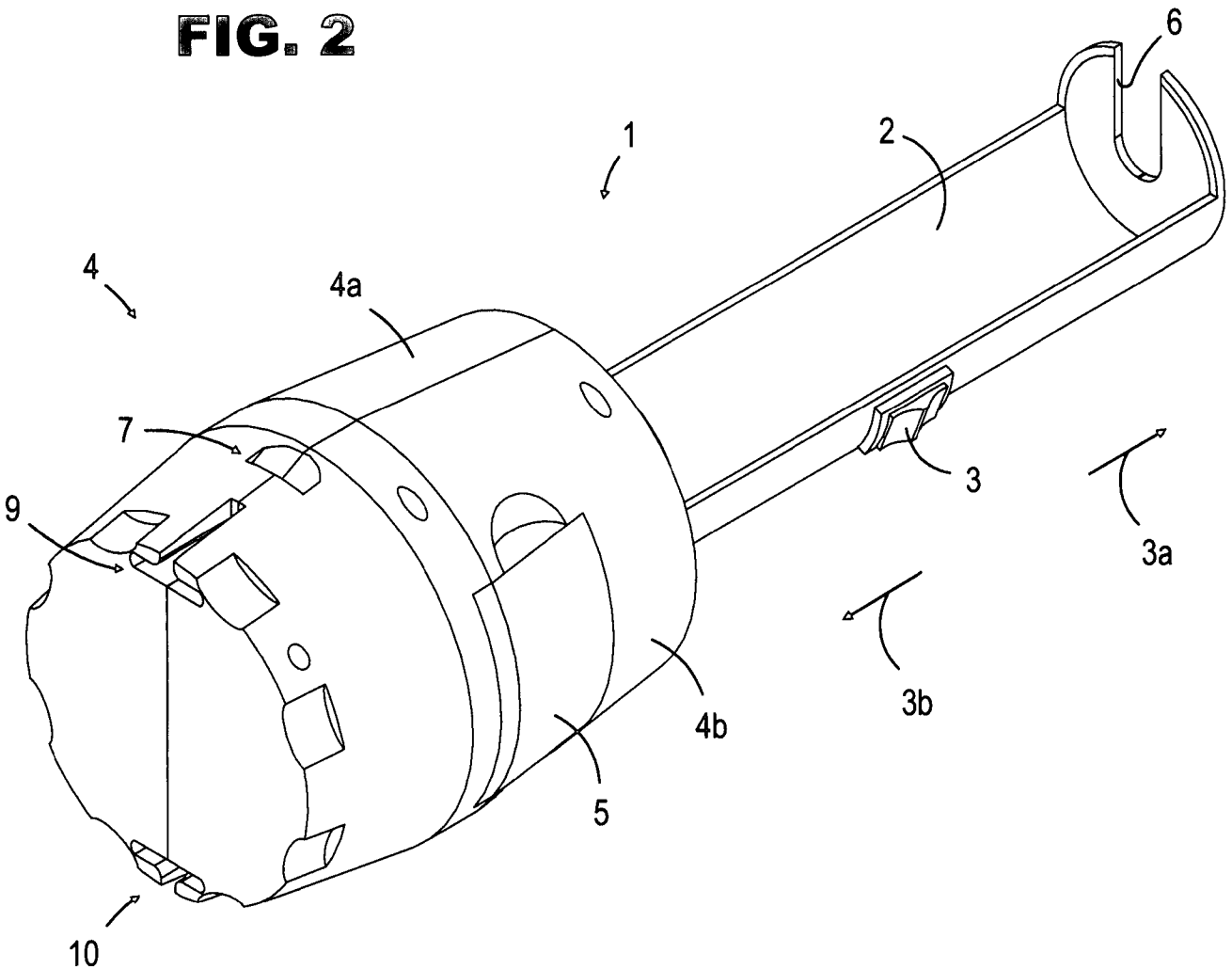
FIG. 2 is a rear perspective view of the compact powered caulking gun.
Figure 3:
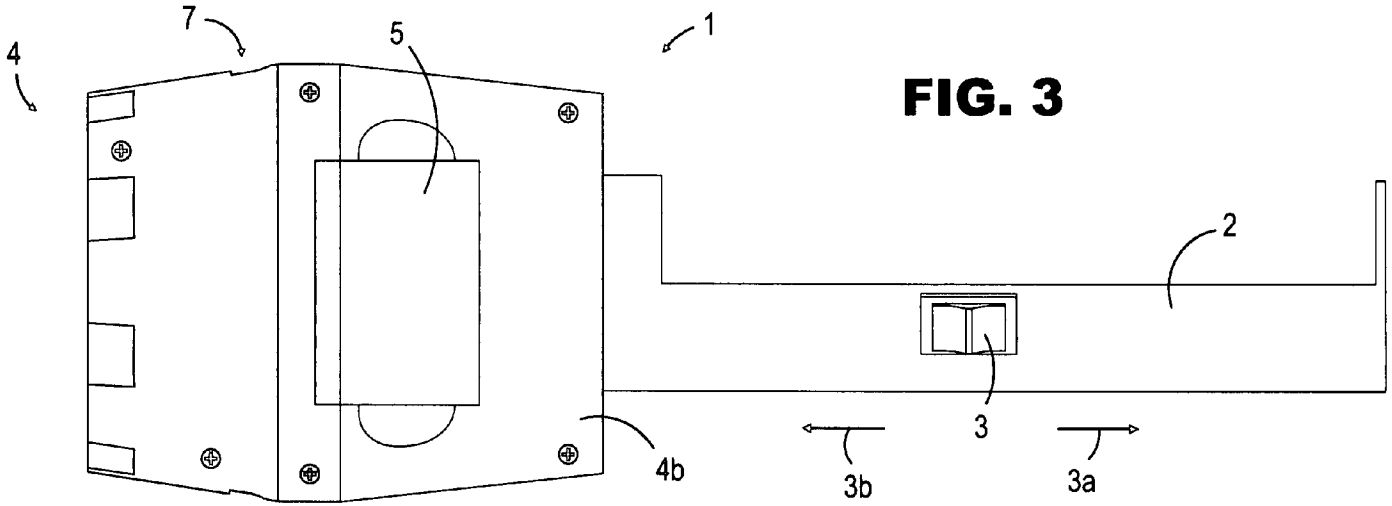
FIG. 3 is a side elevation view of the compact powered caulking gun.
Figure 4:
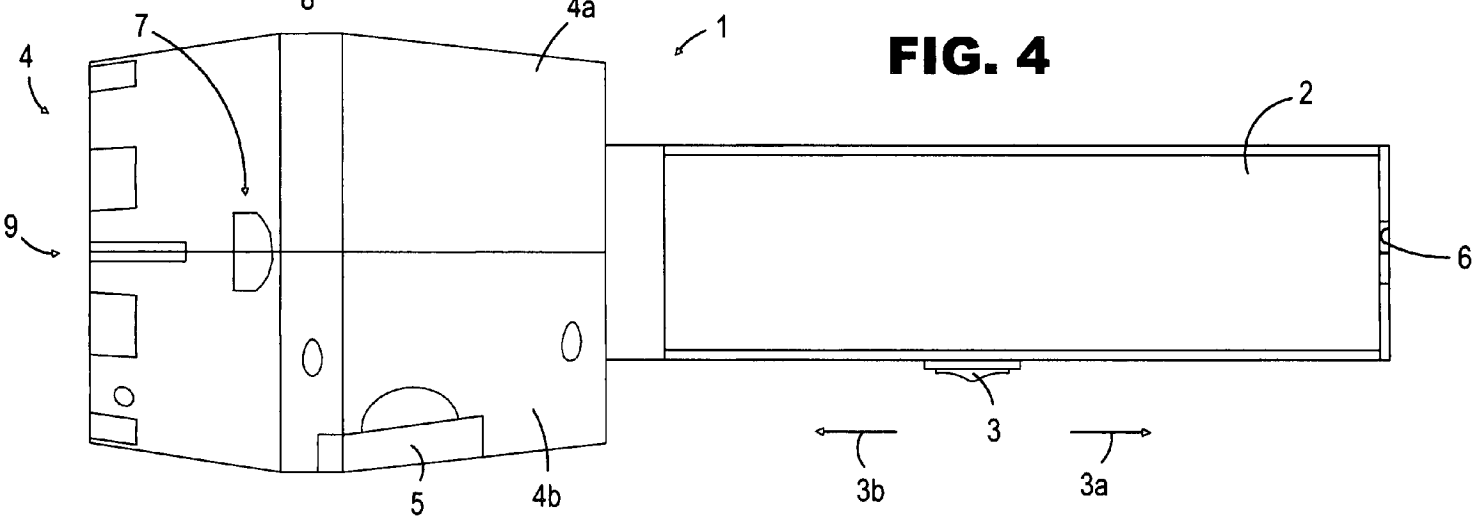
FIG. 4 is a plan view of the compact powered caulking gun.
Figure 5:
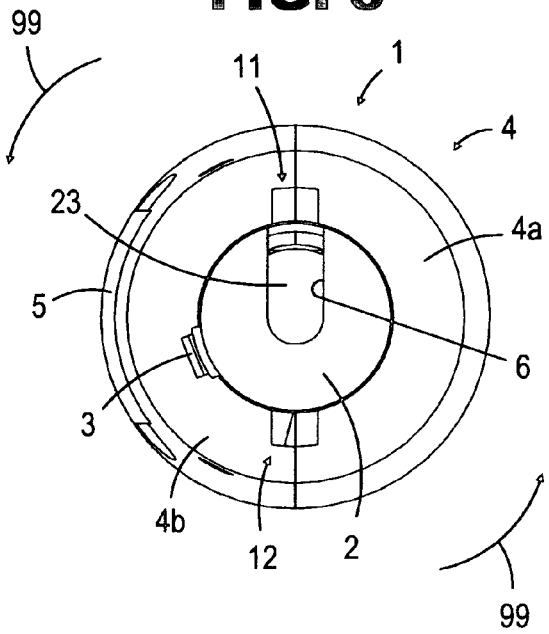
FIG. 5 is a front elevation view of the compact powered caulking gun.
Figure 6:
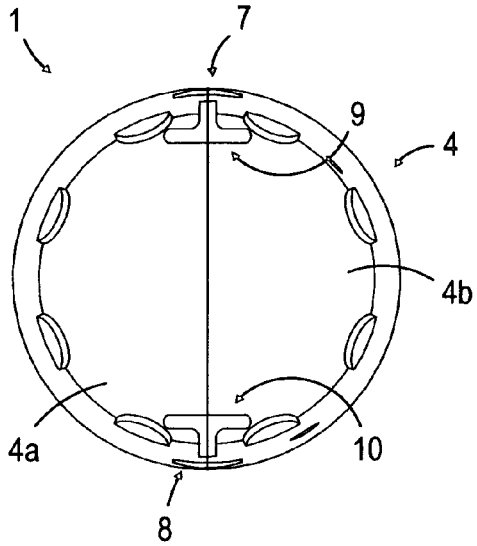
FIG. 6 is a rear elevation view of the compact powered caulking gun.
Figure 7:
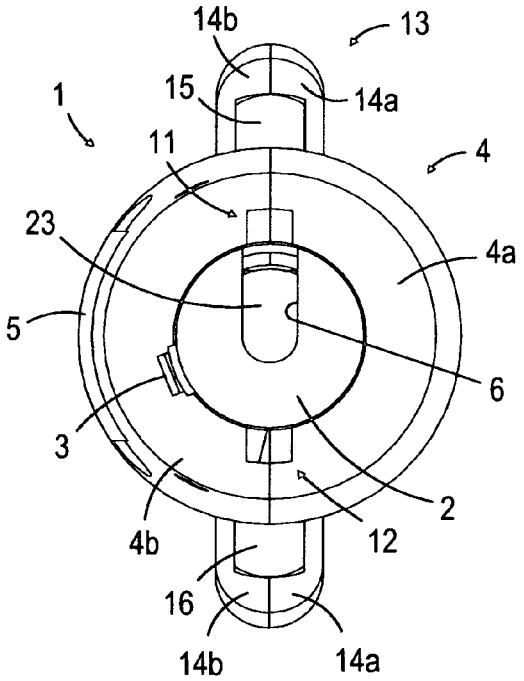
FIG. 7 is a front elevation view of the compact powered caulking gun with the optional rear handle attached.
Figure 8:
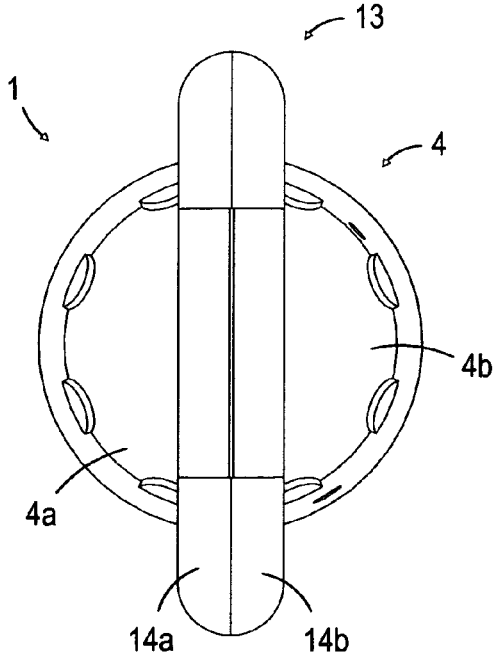
FIG. 8 is a rear elevation view of the compact powered caulking gun with the optional rear handle attached.
Figure 9:
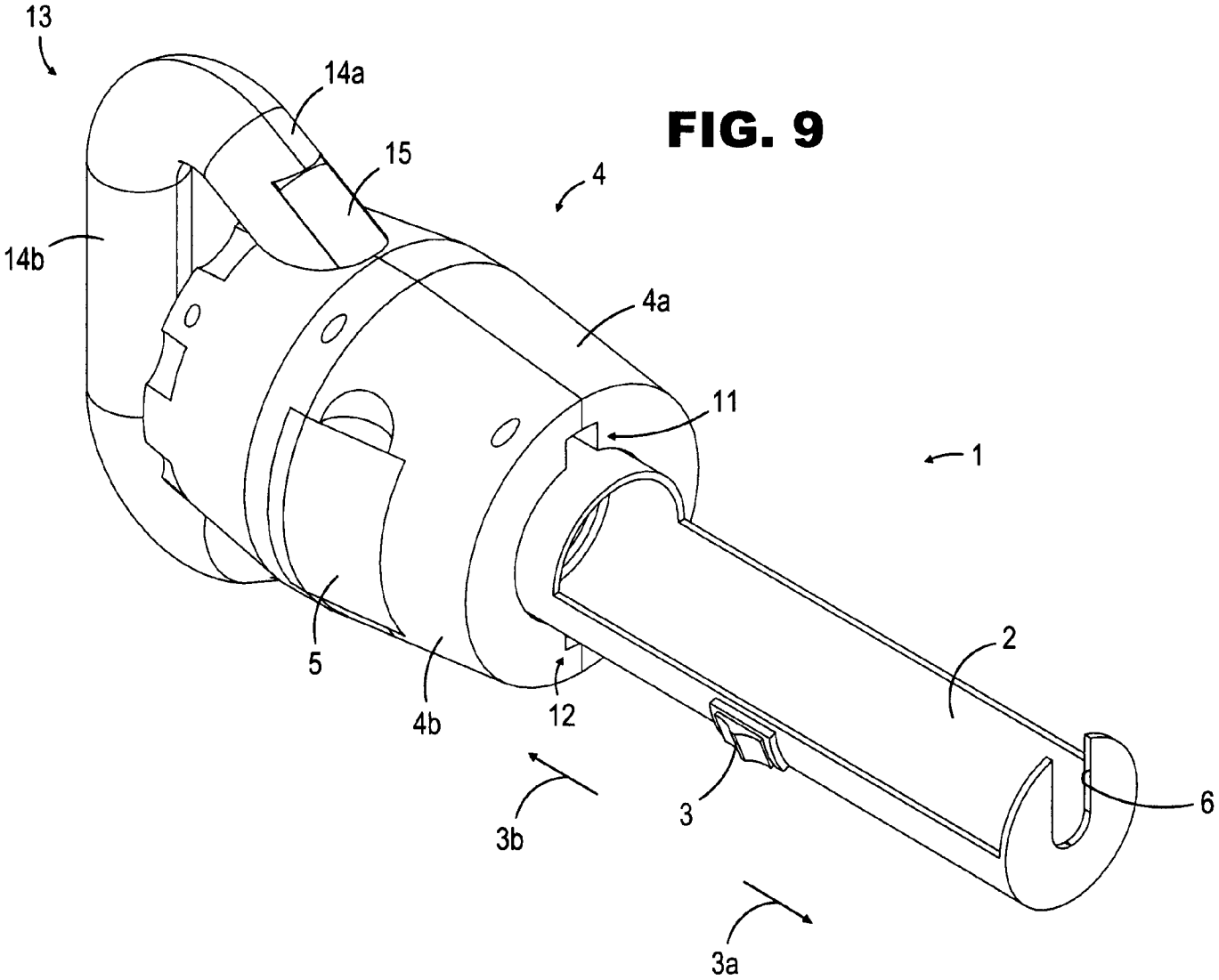
FIG. 9 is a front perspective view of the compact powered caulking gun with the optional rear handle attached.
Figure 10:
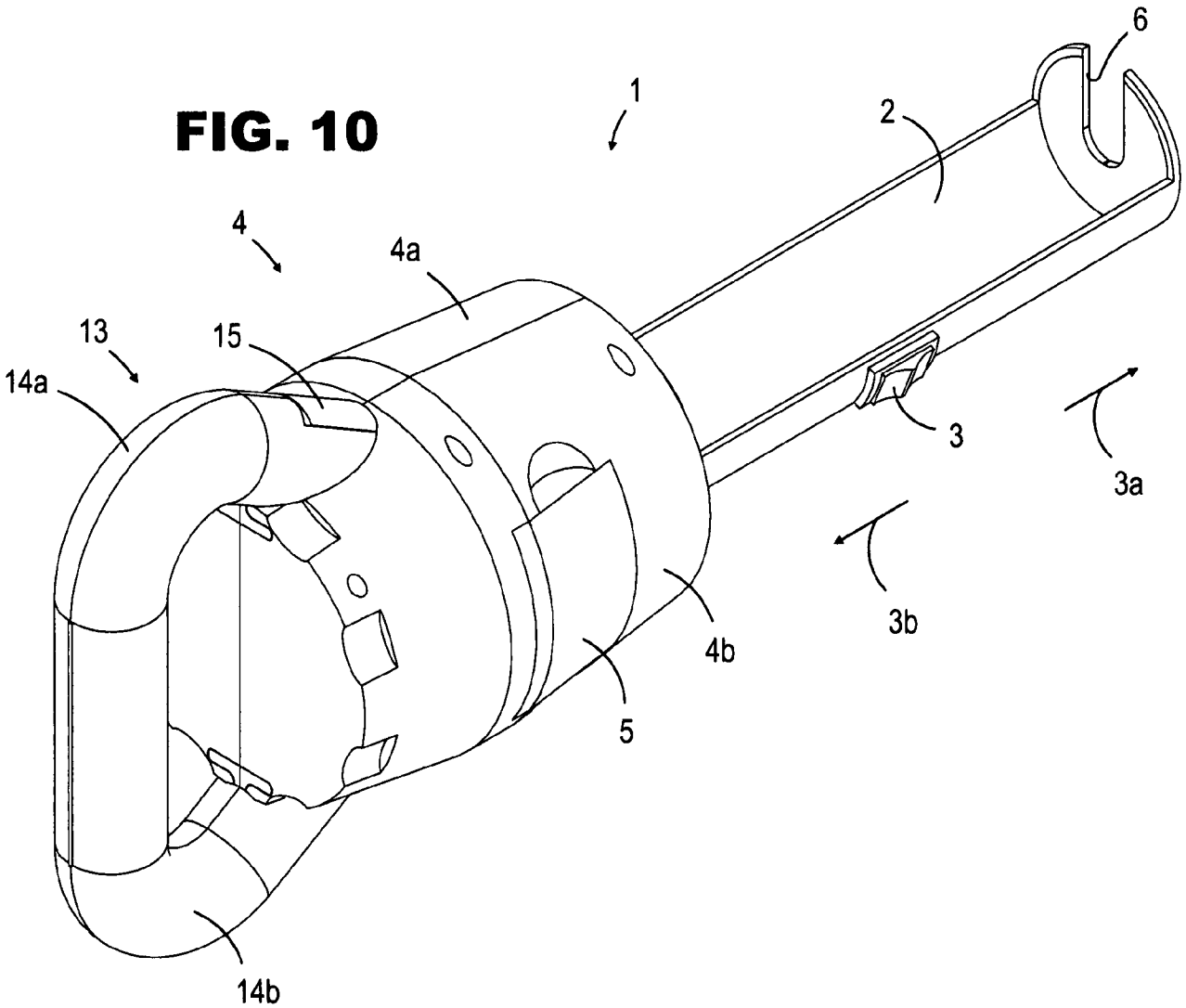
FIG. 10 is a rear perspective view of the compact powered caulking gun with the optional rear handle attached.
Figure 11:
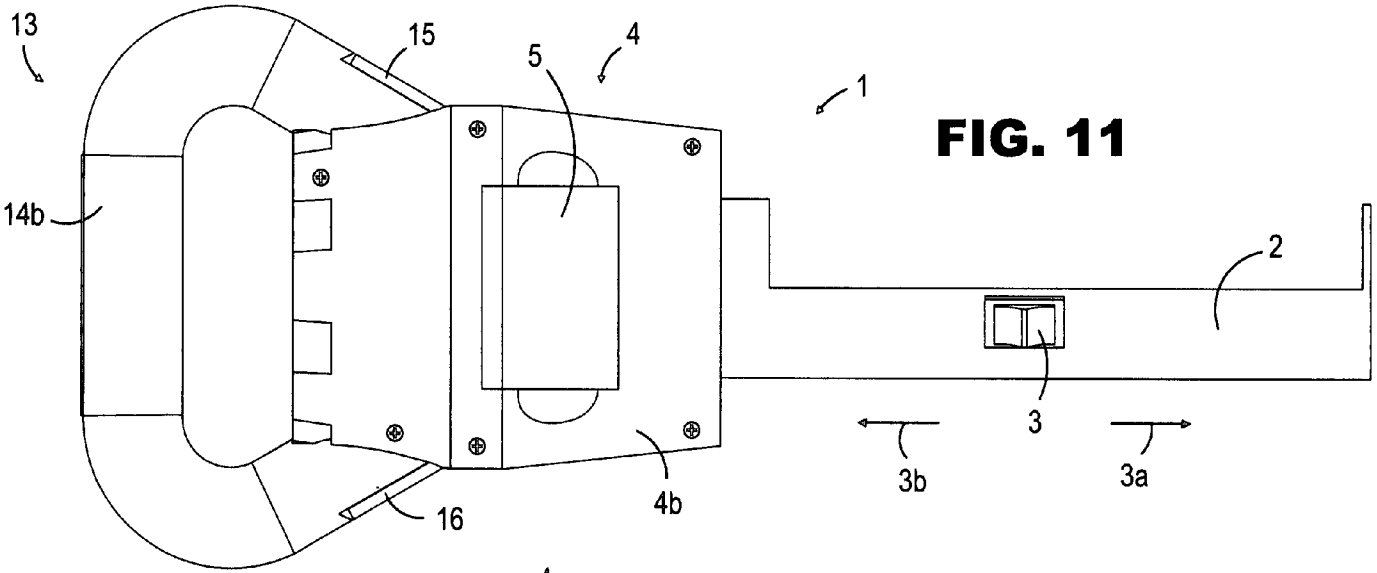
FIG. 11 is a side elevation view of the compact powered caulking gun with the optional rear handle attached.
Figure 12:
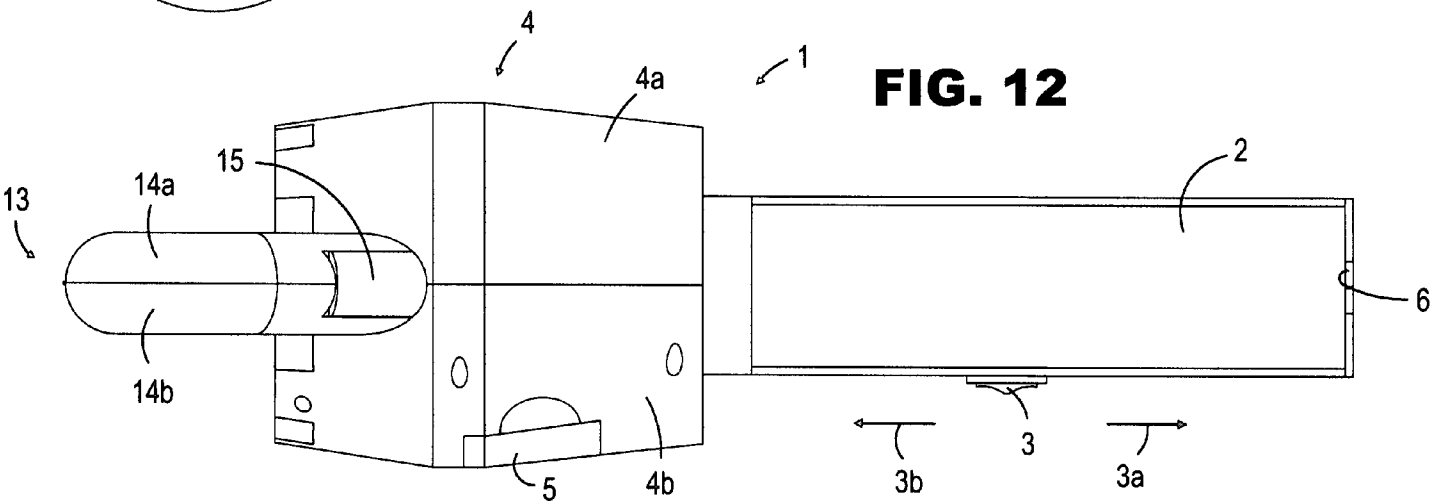
FIG. 12 is a plan view of the compact powered caulking gun with the optional rear handle attached.
Figure 13:
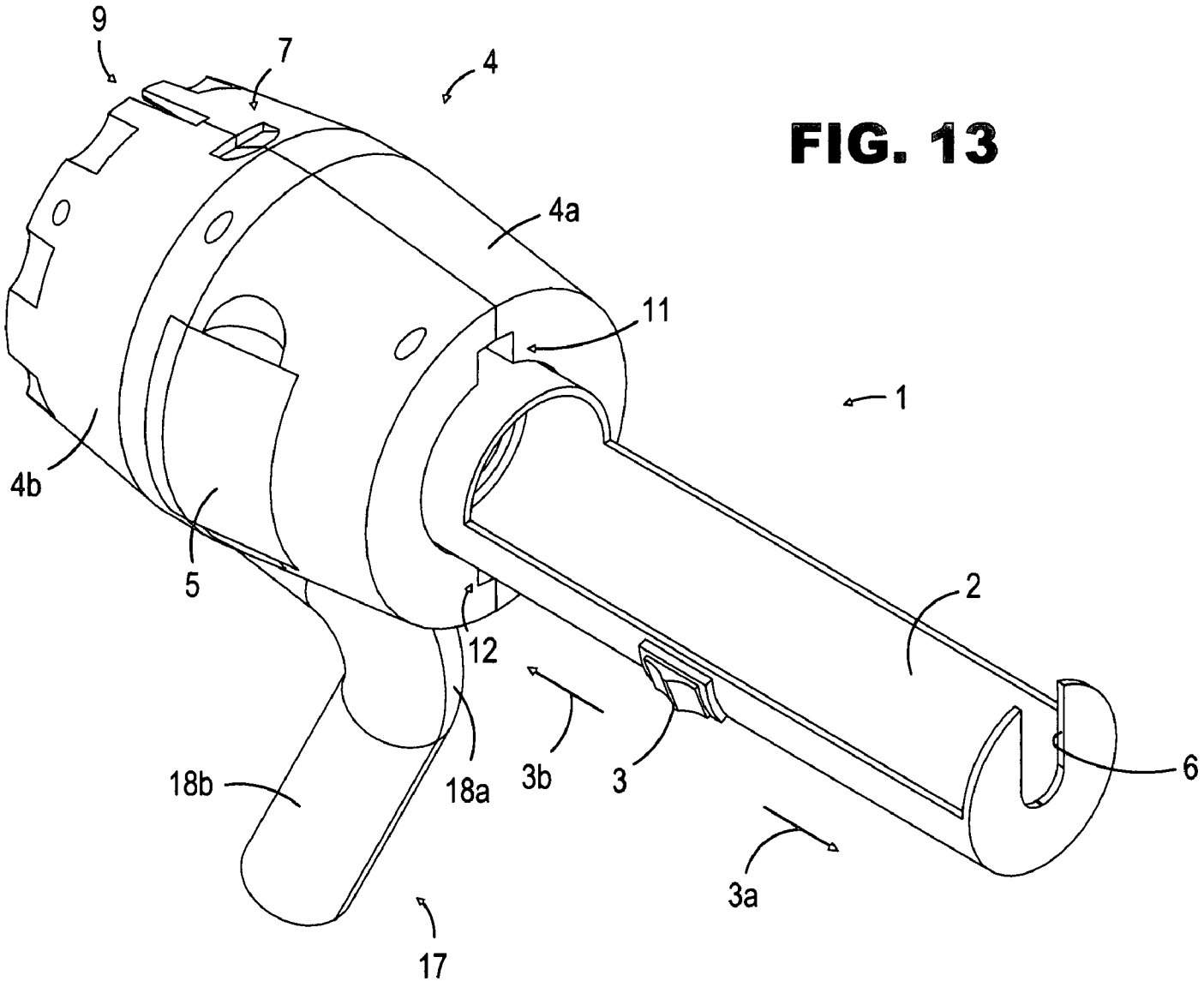
FIG. 13 is a front perspective view of the compact powered caulking gun with the optional gun-type handle attached.
Figure 14:
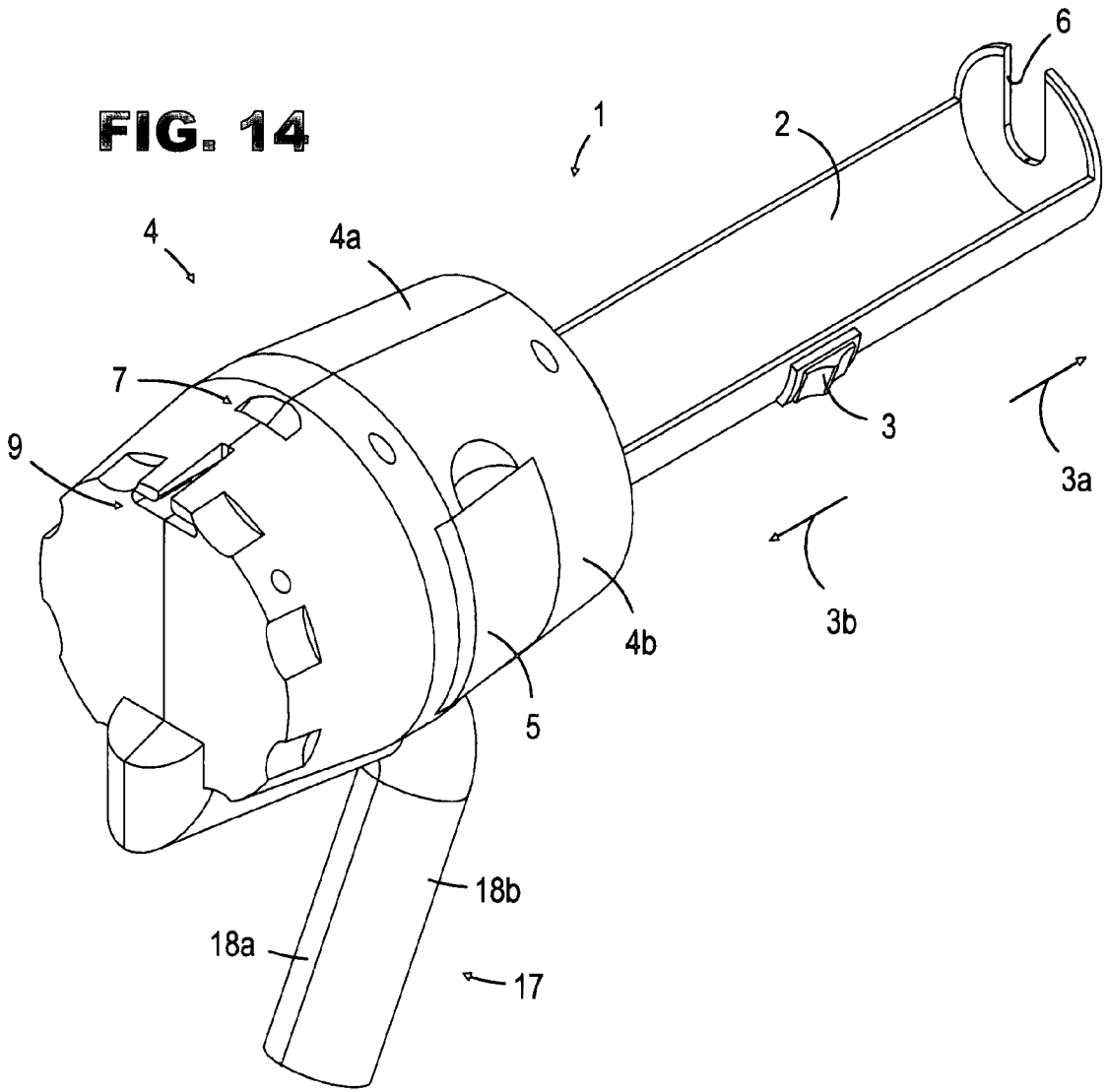
FIG. 14 is a rear perspective view of the compact powered caulking gun with the optional gun-type handle attached.
Figure 18:
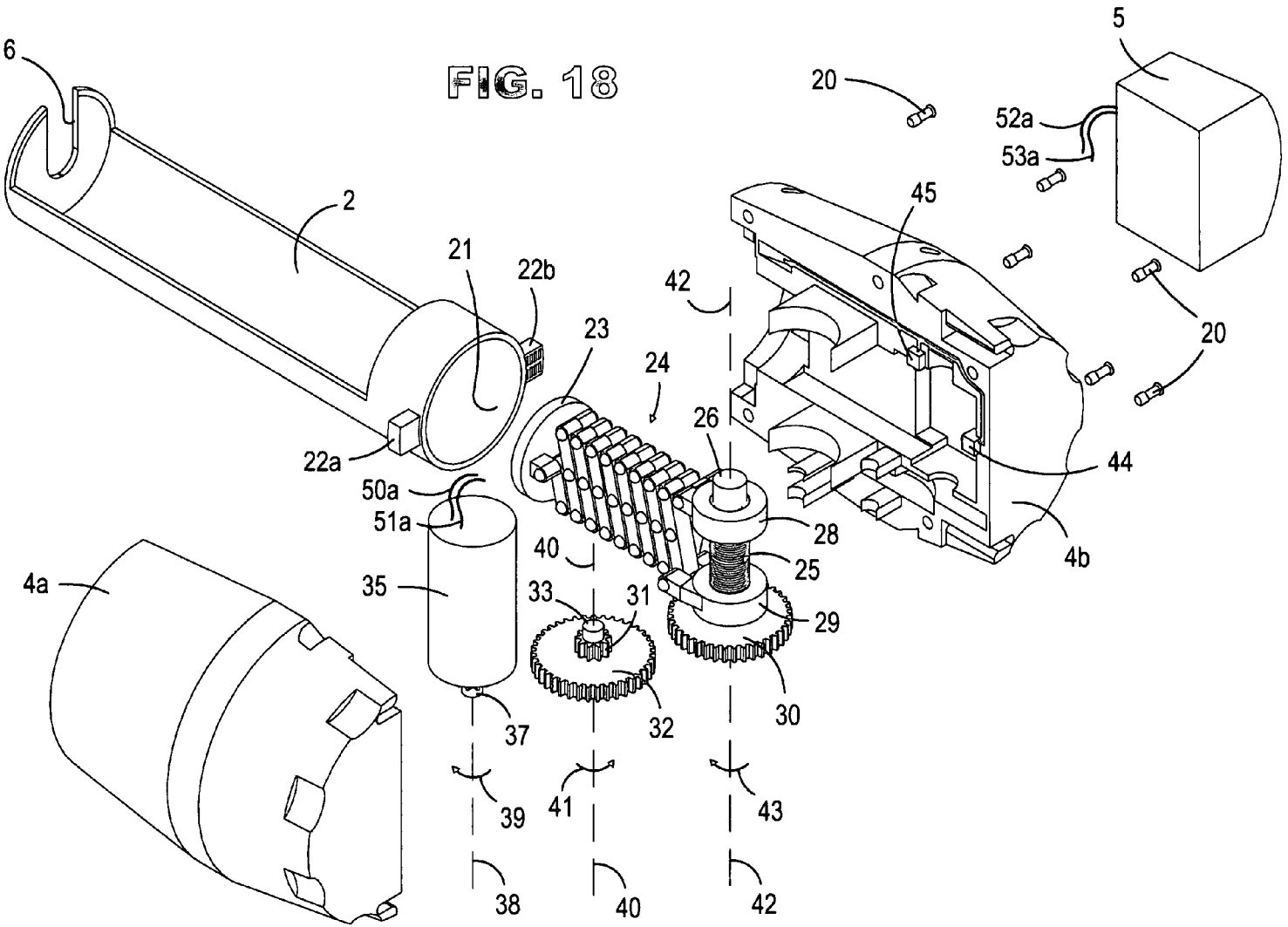
FIG. 18 is an exploded view of the compact powered caulking gun.
Figure 27:
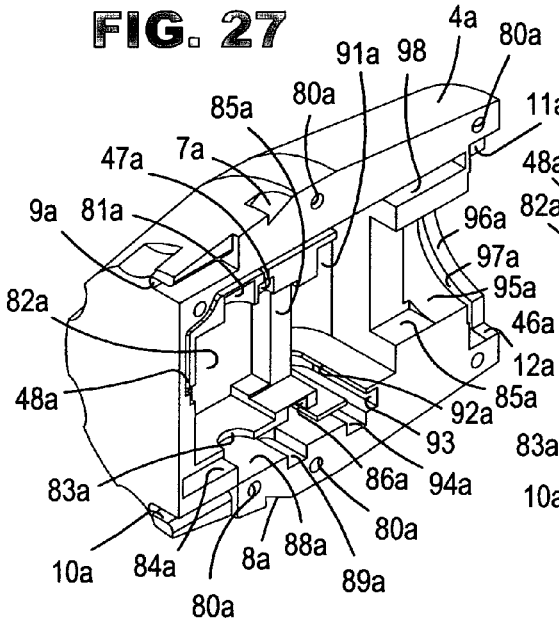
FIG. 27 is a rear perspective view of the left clamshell of the compact powered caulking gun body.
Figure 28:
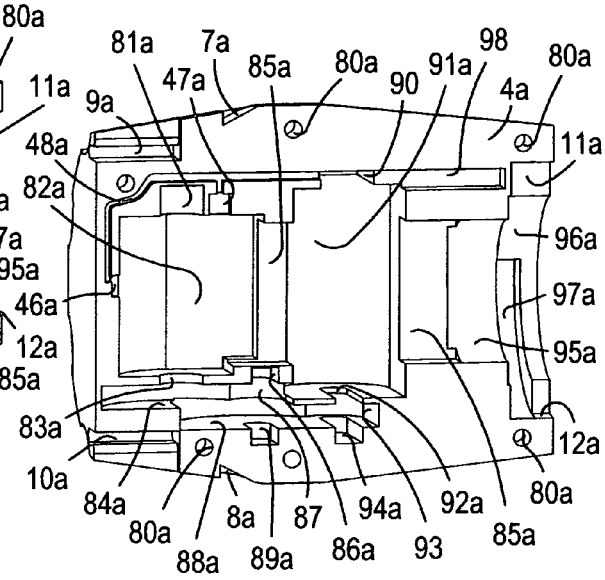
FIG. 28 is another rear perspective view of the left clamshell of the compact powered caulking gun body.
Figure 29:
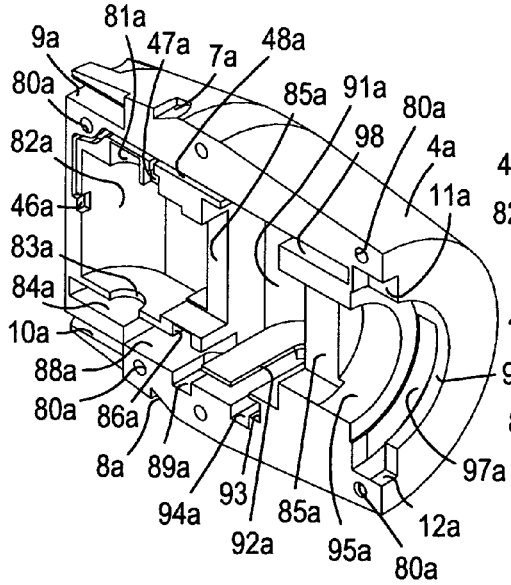
FIG. 29 is a front perspective view of the left clamshell of the compact powered caulking gun body.
Figure 30:
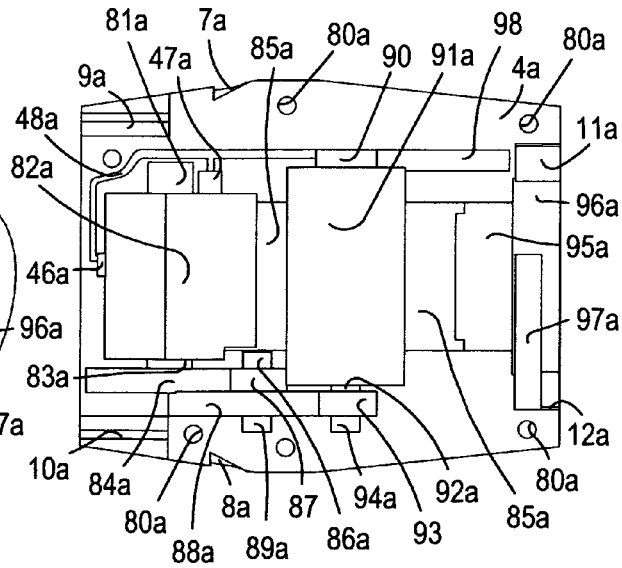
FIG. 30 is a side elevation view of the left clamshell of the compact powered caulking gun body.
Figure 31:
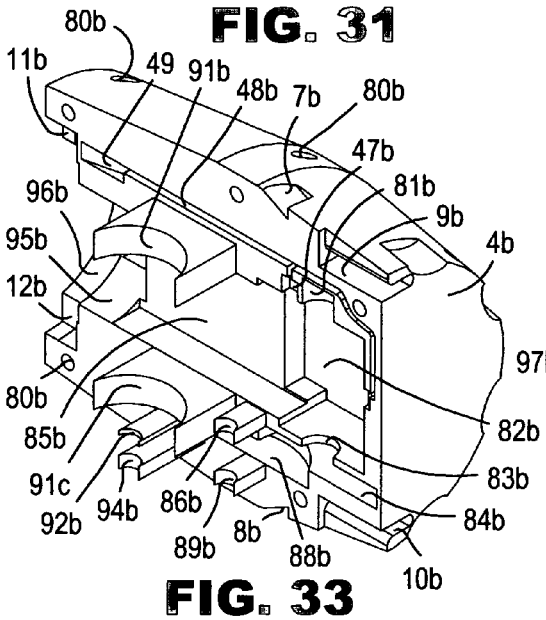
FIG. 31 is a rear perspective view of the right clamshell of the compact powered caulking gun body.
Figure 32:
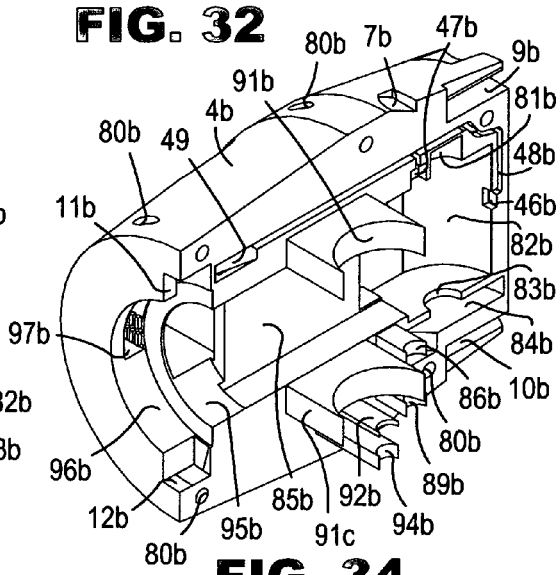
FIG. 32 is a front perspective view of the right clamshell of the compact powered caulking gun body.
Figure 33:
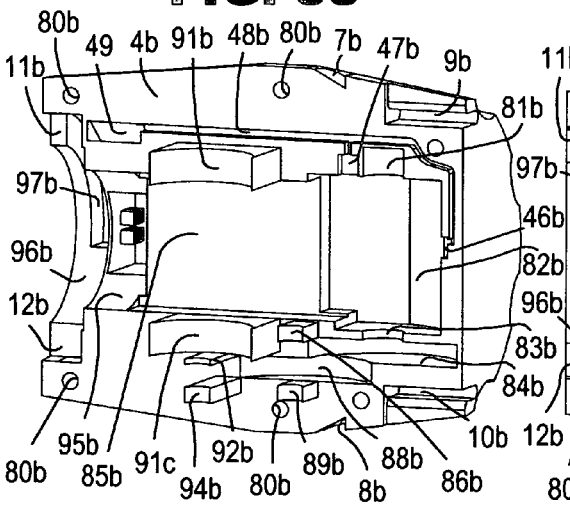
FIG. 33 is another rear perspective view of the right clamshell of the compact powered caulking gun body.
Figure 34:
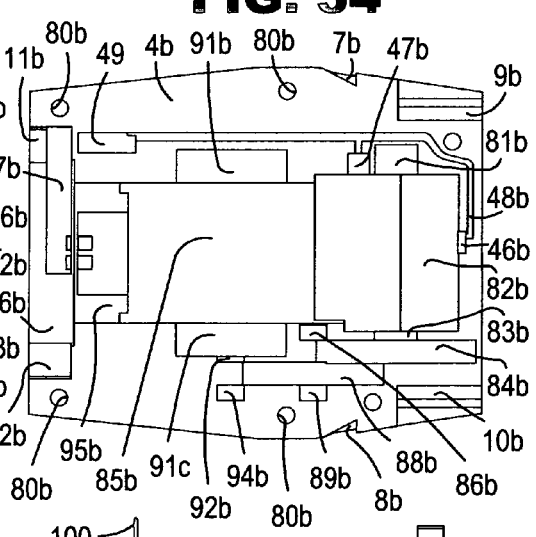
FIG. 34 is a side elevation view of the right clamshell of the compact powered caulking gun body.
Figure 35:
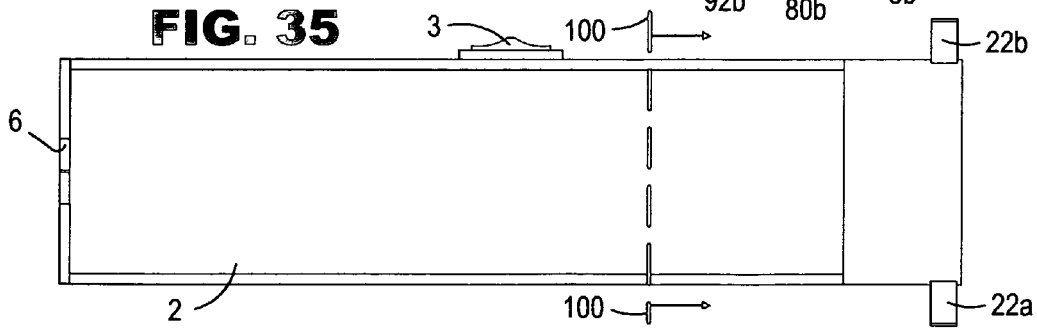
FIG. 35 is a plan view of the cartridge cradle.

A compact powered caulking gun (1) (shown in FIG. 1-18), having a body (4), made of two clamshells (4*a*, 4*b*) (as shown in FIG. 27-34), secured to each other through the openings (80*a*, 80*b*) of clamshells (4*a*, 4*b*) respectively, via screws (20) (shown in FIG. 18). A cartridge cradle (2) is removably attached to the body (4) via openings (11, 12). An optional attachable, detachable rear handle (13) (shown in FIG. 7-12, 46-51) can be securely attached onto the rear of clamshells (4*a*, 4*b*) of body (4). An optional attachable, detachable gun-type handle (17) (shown in FIG. 13-17, 52-56) can be securely attached onto the rear of clamshells (4*a*, 4*b*) of body (4).

Figure 36:
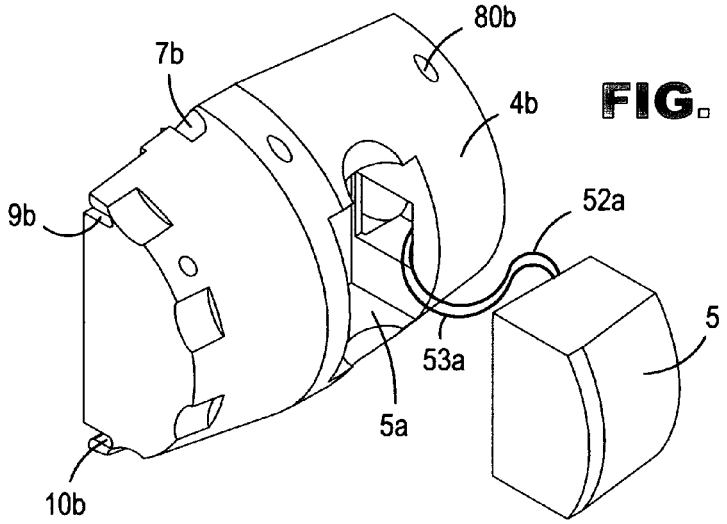
FIG. 36 is a rear perspective view of the right clamshell of the compact powered caulking gun body with the battery removed.
Figure 37:
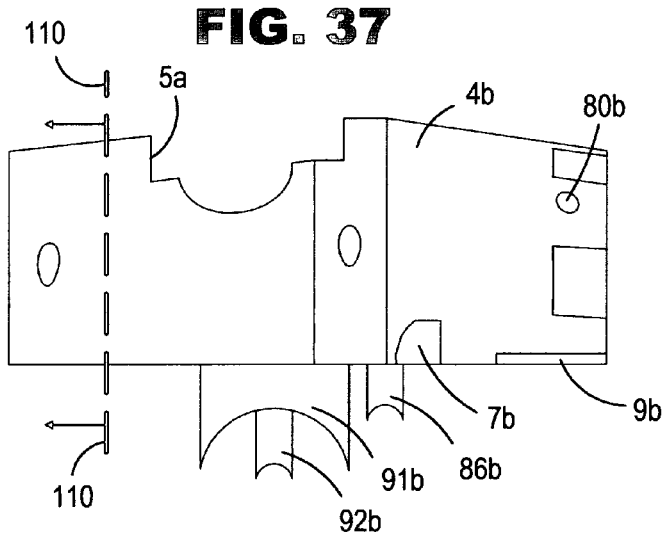
FIG. 37 is a plan view of the right clamshell of the compact powered caulking gun body.
Figure 42:
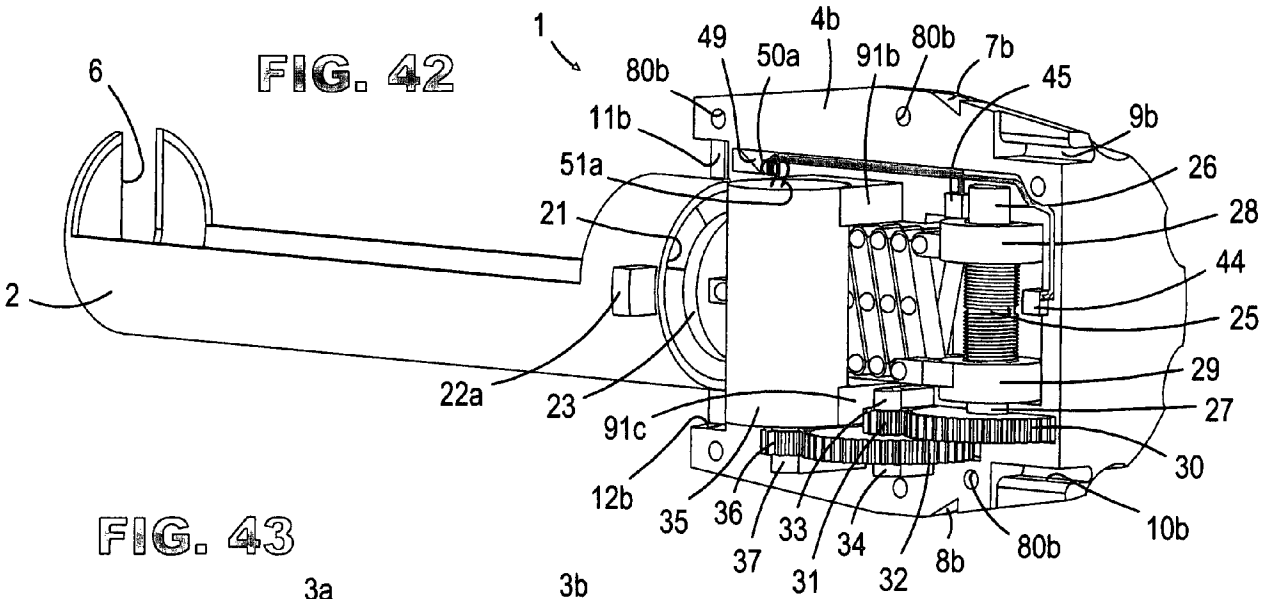
FIG. 42 is a rear perspective view of the compact powered caulking gun with the left clamshell removed showing the scissor-type mechanism.
Figure 43:
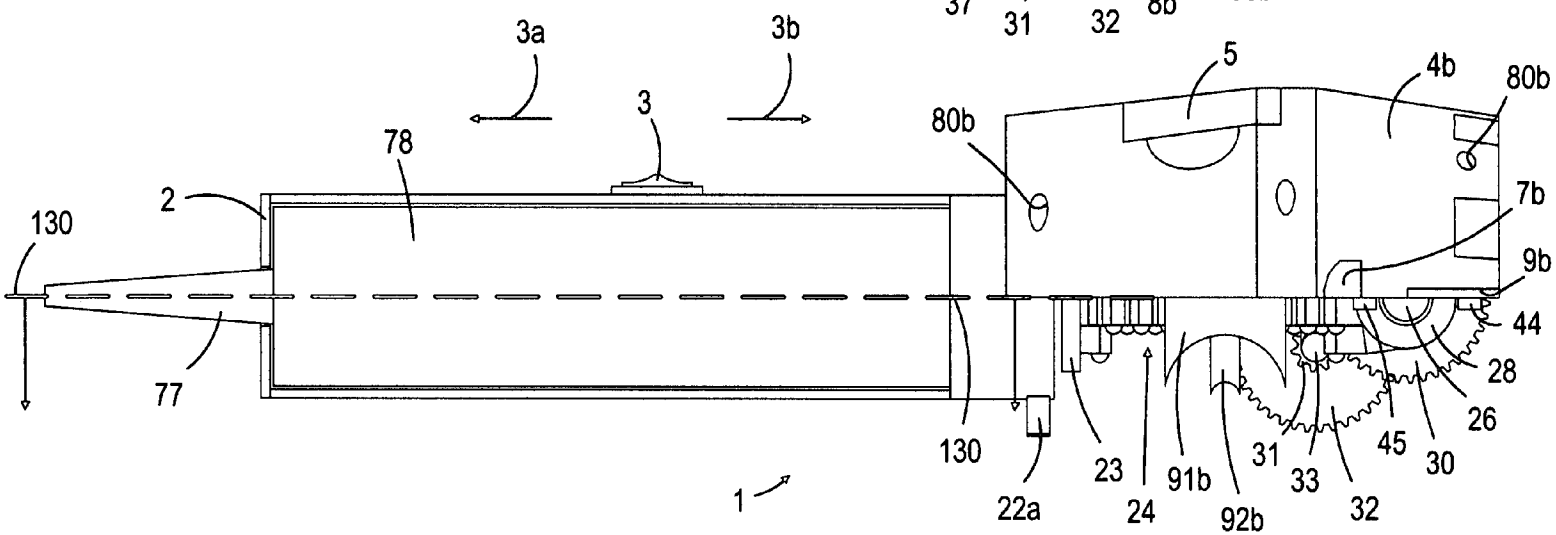
FIG. 43 is a plan view of the compact powered caulking gun with the left clamshell removed.

The motor (35) (shown in FIG. 18, 41, 42) is securely encased in recess (91*a*) (shown in FIG. 27-30) formed into clamshell (4*a*) of body (4). The motor (35) is further secured in place with supports (91*b*, 91*c*) formed onto clamshell (4*b*) of body (4) (shown in FIG. 31-34, 42-45). The motor (35) can be electric and powered by rechargeable battery (5). The battery compartment (5*a*) (shown in FIG. 36) formed into clamshell (4*b*) of body (4), could be designed to not only accommodate the rechargeable battery (5), but also a plurality of one time use regular AA batteries (not shown) or the like. The motor (35) is connected to a rotatable drive shaft (37) with gear (36) formed thereon (shown in FIG. 42). The drive shaft (37), the gear (36) are rotatably situated in recesses (92*a*, 93, 94*a*) respectively, formed into clamshell (4*a*). The drive shaft (37) is further rotatably secured in place with supports (92*b*, 94*b*) formed onto clamshell (4*b*) of body (4) (shown in FIG. 31-34). The gear (36) of drive shaft (37) is rotatably and meshingly coupled to transfer gear (32) (shown in FIG. 42). The transfer gear (32) has an end-shaft (34) formed on one side, and a smaller transfer gear (31) with an end-shaft (33) formed on the other side (shown in FIG. 42). The end-shaft (34), the transfer gear (32), the small transfer gear (31), and the end-shaft (33), are rotatably situated in recesses (86*a*, 87, 88*a*, 88*b*, 89*a*) respectively, formed into clamshells (4*a*, 4*b*) respectively. The end-shaft (33), and the end-shaft (34), are further rotatably secured in place with supports (86*b*, 89*b*) formed onto clamshell (4*b*) of body (4) (shown in FIG. 31-34). The transfer gear (32), and the small transfer gear (31), are rotatably and meshingly coupled to the gear (30) of actuator shaft (25) (shown in FIG. 42). The upper end-shaft (26) and lower end-shaft (27) of actuator shaft (25) attached to gear (30) are rotatably situated in recesses (81*a*, 81*b*, 83*a*, 83*b*, 82*a*, 82*b*, 84*a*, 84*b*) respectively, formed into clamshells (4*a*, 4*b*) respectively.

The actuator shaft (25) has two oppositely pitched threads (25*a*, 25*b*) formed thereon (shown in FIG. 22). The upper thread (25*a*) is rotatably coupled to the upper link member actuator (28) which has a matching pitched thread (28*a*) formed therein (shown in FIG. 18-21, 24). The lower thread (25*b*) is rotatably coupled to the lower link member actuator (29) which has a matching pitched thread (29*a*) formed therein (shown in FIG. 18-21, 25). The upper link member actuator (28) has two protruding arms (60*a*, 60*b*) formed thereon (shown in FIG. 24). Each of the arms (602, 60*b*) has an opening (702, 70*b*) formed therein respectively. The lower link member actuator (29) has two protruding arms (61*a*, 61*b*) formed thereon (shown in FIG. 25). Each of the arms (61*a*, 61*b*) has an opening (71*a*, 71*b*) formed therein respectively. The scissor type mechanism (24) (shown in FIG. 18-21, 41-45) is made of a plurality of link members (63*a*, 63*b*) and two short link members (65*a*, 65*b*) (shown in FIG. 19-21, 26) pivotally secured to each other via rivets (68) through openings (72*a*, 72*b*, 73*a*, 73*b*) formed into link members (63*a*, 63*b*) and through openings (75*a*, 75*b*) formed into the two short link members (65*a*, 65*b*) respectively. The link member (63*b*) is pivotally secured to arms (60*a*, 60*b*) of the upper link member actuator (28) through openings (70*a*, 72*b*, 70*b*) with rivet (62) (shown in FIG. 19-21). The link member (63*a*) is pivotally secured to arms (61*a*, 61*b*) of the lower link member actuator (29) through openings (71*a*, 72*a*, 71*b*) with rivet (62)

(shown in FIG. 19-21). The pusher plate (23) (shown in FIG. 23) is attached to the two short link members (65*a*, 65*b*) through openings (69*a*, 69*b*) formed into arms (66*a*, 66*b*) respectively, of pusher plate (23) and through openings (74*a*, 74*b*) formed into the two short link members (65*a*, 65*b*) respectively and pivotally secured in place with rivet (67) (shown in FIG. 19-21, 23). The scissor-type mechanism (24) in its retracted position with pusher plate (23) (shown in FIG. 41-44) is situated inside recesses (85*a*, 85*b*, 95*a*, 95*b*) respectively (shown in FIG. 27-34) formed into clamshells (4*a*, 4*b*) respectively.

Figure 38:
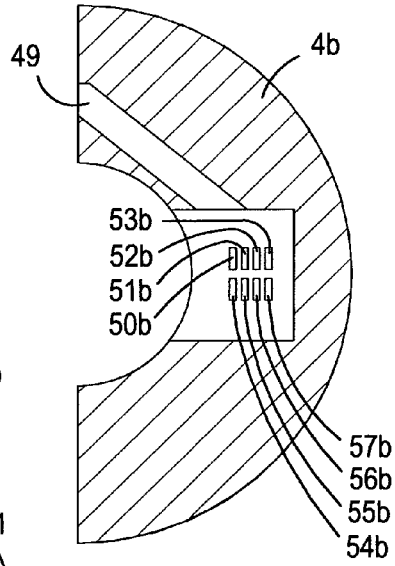
FIG. 38 is a rear cross sectional view of the right clamshell of the compact powered caulking gun body taken on line 110-110 of FIG. 37.
Figure 39:
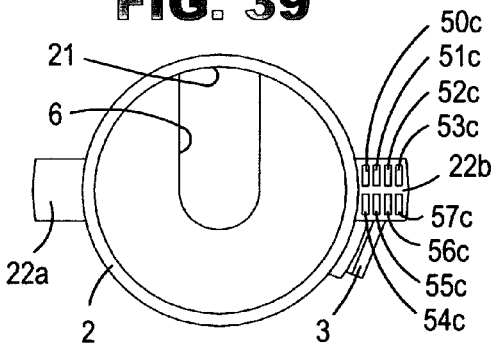
FIG. 39 is a rear elevation view of the cartridge cradle.
Figure 40:
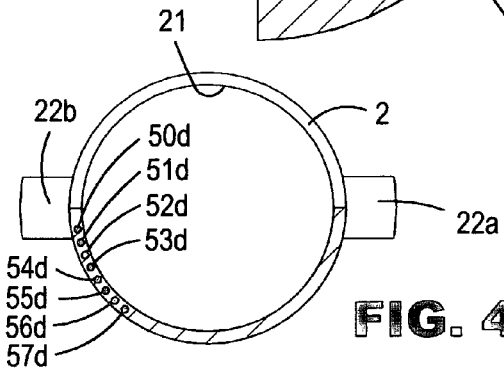
FIG. 40 is a front cross sectional view of the cartridge cradle taken on line 100-100 of FIG. 35.

The removable cartridge cradle (2) (shown in FIG. 18, 35, 39-43) has two protruding tabs (22*a*, 22*b*) formed thereon. The removable cartridge cradle (2) is sized to accommodate commercially available caulk, adhesive or other viscous cartridge (78). A slot (6) is formed into the front part of cartridge cradle (2) to accommodate the nozzle (77) of a cartridge (78). The removable cartridge cradle (2) is preferably made of plastic (but composition is not limited to plastic). A three position rheostatic extrusion speed regulator, Forward-On, Off, Reverse-On switch (3) is integrally formed on the side of the removable cartridge cradle (2). As seen in FIG. 39, 40, insulated electrical wires (50*d*, 51*d*, 52*d*, 53*d*, 54*d*, 55*d*, 56*d*, 57*d*) are embedded in the cartridge cradle (2), that connect the electrical terminals (50*c*, 51*c*, 52*c*, 53*c*, 54*c*, 55*c*, 56*c*, 57*c*) embedded in tab (22*b*) to the rheostatic extrusion speed regulator, Forward-On, Off, Reverse-On switch (3). To securely install the cartridge cradle (2) into the body (4), the cartridge cradle (2) is positioned so that tab (22*a*) and tab (22*b*) lines up with and slides into opening (11) and opening (12) respectively. And the rear part of cartridge cradle (2) slides into recesses (96*a*, 96*b*) of clamshell (4*a*, 4*b*) respectively. Opening (11) consists of recesses (11*a*, 11*b*) formed into clamshell (4*a*, 4*b*) respectively. Opening (12) consists of recesses (12*a*, 12*b*) formed into clamshell (4*a*, 4*b*) respectively. Once tab (22*a*) and tab (22*b*) are inside opening (11) and opening (12) respectively the cartridge cradle (2) is rotated 90 degrees inside recesses (97*a*, 97*b*) respectively, in the direction indicated by arrow (99) in FIG. 5. In its secured position the electrical terminals (50*c*, 51*c*, 52*c*, 53*c*, 54*c*, 55*c*, 56*c*, 57*c*) of tab (22*b*) are electrically connected to contacts (50*b*, 51*b*, 52*b*, 53*b*, 54*b*, 55*b*, 56*b*, 57*b*) respectively, embedded into clamshell (4*b*) (shown in FIG. 38).

Figure 41:
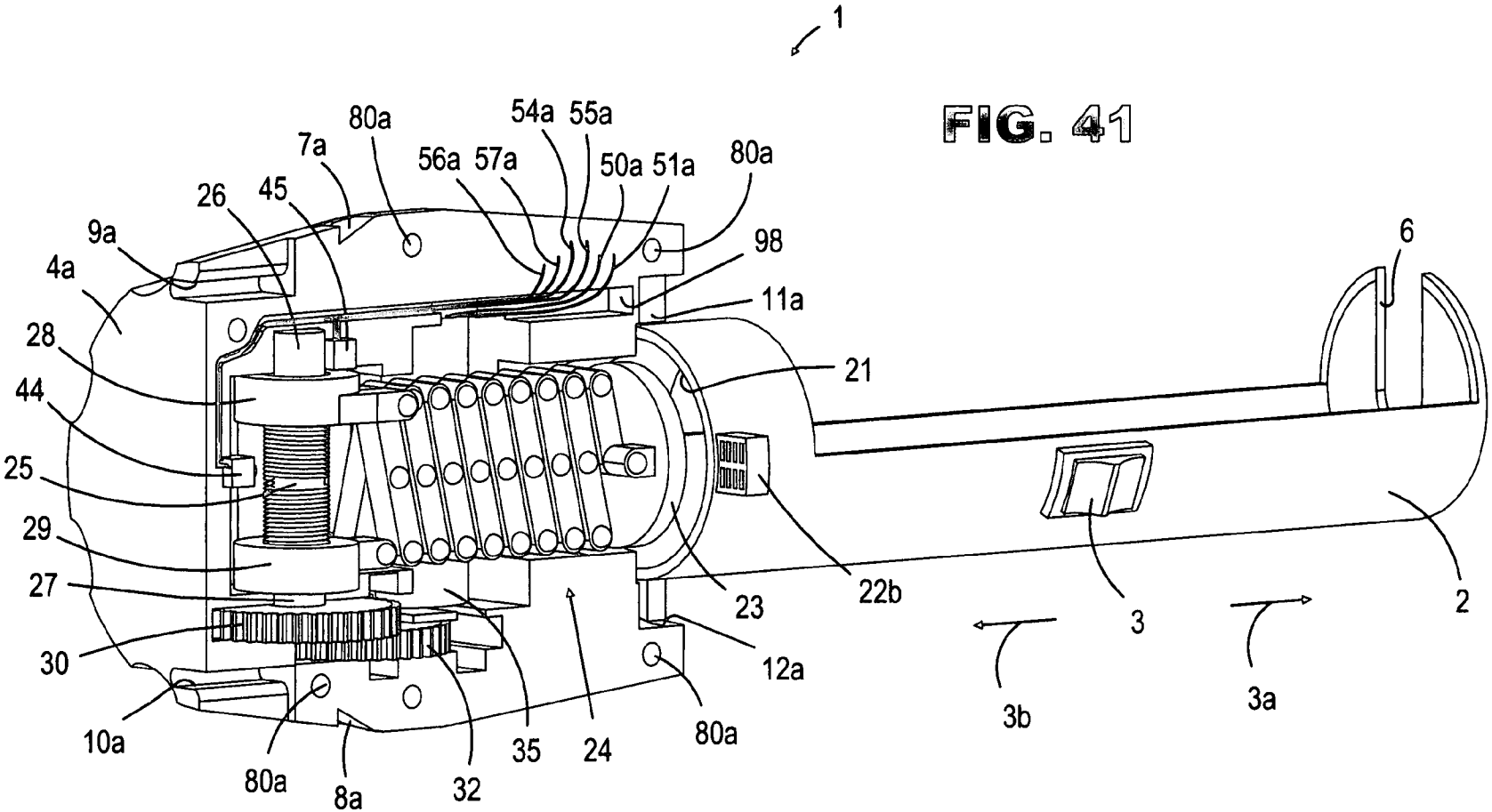
FIG. 41 is a rear perspective view of the compact powered caulking gun with the right clamshell removed showing the scissor-type mechanism.

The Cut-Off switches (44, 45) (shown in FIG. 18, 41-45) are securely situated in recesses (46*a*, 46*b*, 47*a*, 47*b*) of clamshells (4*a*, 4*b*) respectively, of body (4) (shown in FIG. 27-34). The Cut-Off switch (44) is electrically connected via insulated wires (56*a*, 57*a*) to contacts (56*b*, 57*b*) respectively. And the Cut-Off switch (45) is electrically connected via insulated wires (54*a*, 55*a*) to contacts (54*b*, 55*b*) respectively. The purpose of the Cut-Off switch (44) is to cut off electricity to the motor (35) when the scissor-type mechanism (24) is in its fully extended position (shown in FIG. 45) to prevent any internal damage to the compact powered caulking gun (1). And the purpose of the Cut-Off switch (45) is to cut off electricity to the motor (35) when the scissor-type mechanism (24) is in its fully retracted position (shown in FIG. 44) to prevent any internal damage to the compact powered caulking gun (1). The insulated electrical wires (50*a*, 51*a*) of motor (35) are connected to their respective contacts (50*b*, 51*b*). In FIG. 41, the insulated electrical wires (50*a*, 51*a*, 54*a*, 55*a*, 56*a*, 57*a*) are separated and truncated for illustration purposes, but in the actual compact powered caulking gun (1), they would be bundled together and situated in recesses (48*a*, 48*b*, 90, 98) of clamshells (4*a*, 4*b*) respectively, and further situated through opening (49) (shown in FIG. 38, 31-34, 41-45) and connected to their respective contacts (50*b*, 51*b*, 54*b*, 55*b*, 56*b*, 57*b*) (as shown in FIG. 38, 42, 44, 45). The insulated electrical wires (52*a*, 53*a*) (shown in FIG. 36) of rechargeable battery (5) are connected to their respective contacts (52*b*, 53*b*) (shown in FIG. 38).

To operate the compact powered caulking gun (1), the operator grasps the cartridge cradle (2), with a cartridge (78) therewithin, with one hand, and with thumb of the same hand actuates the rheostatic extrusion speed regulator, Forward-On, Off, Reverse-On switch (3) to the Forward-On direction indicated by arrow (3*a*). By pushing the switch (3) in the Forward-On direction, the operator activates a built in rheostatic control, which regulates the amount of voltage applied to the motor (35) from the rechargeable battery (5). The farther the operator's thumb pushes the switch (3) in the direction indicated by arrow (3*a*) the more voltage is applied to the motor (35) thereby increasing the extrusion speed of the material from the cartridge (78) through the nozzle (77).

Figure 44:
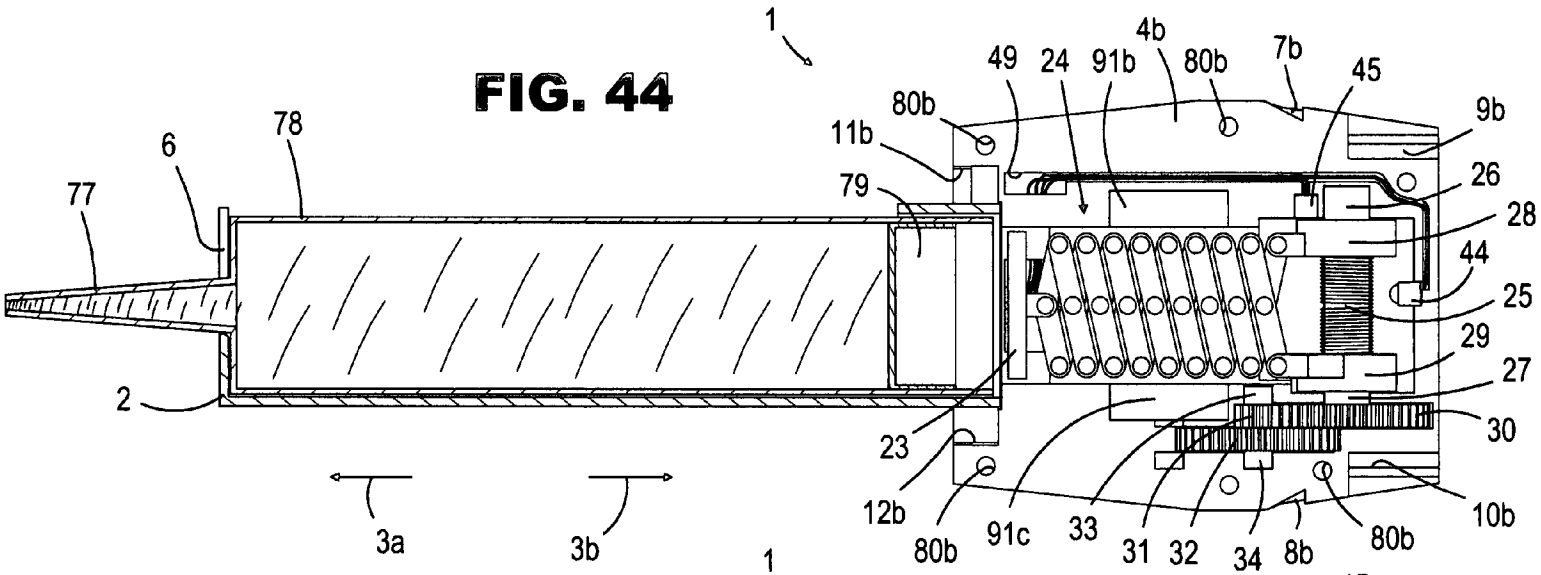
FIG. 44 is a cross sectional view taken on line 130-130 of FIG. 43, of the compact powered caulking gun with the left clamshell removed and showing the scissor-type mechanism in the retracted position.
Figure 45:
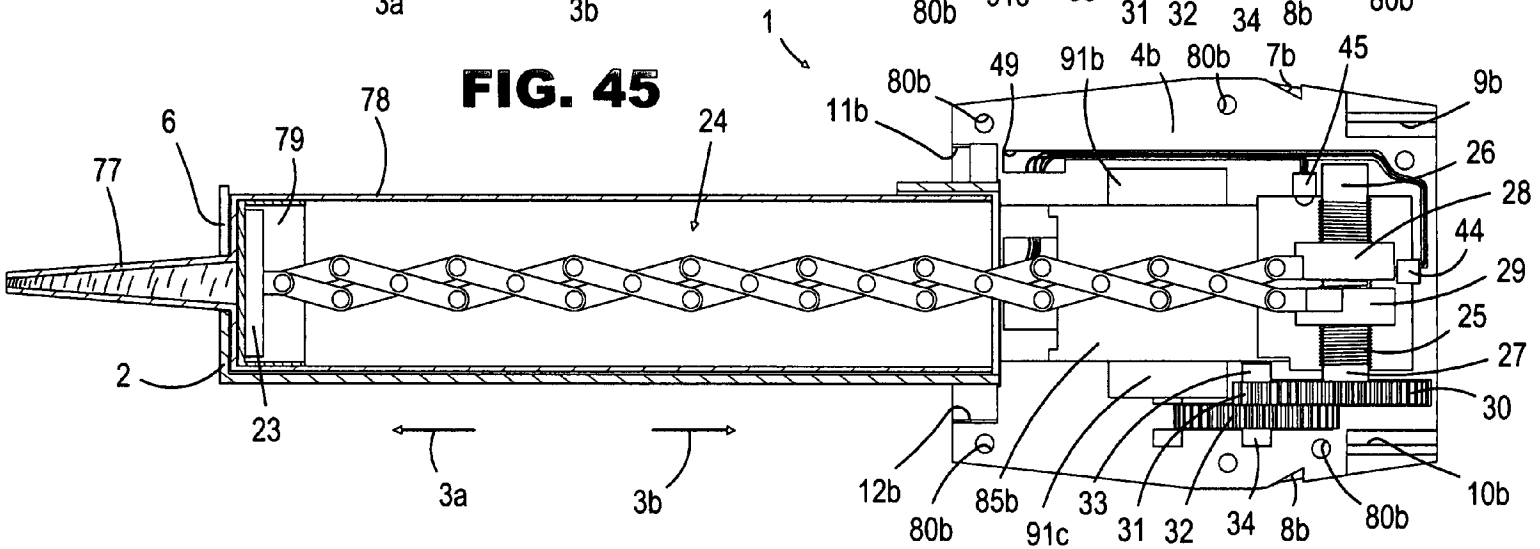
FIG. 45 is a cross sectional view taken on line 130-130 of FIG. 43, of the compact powered caulking gun with the left clamshell removed and showing the scissor-type mechanism in the extended position.
Figure 46:
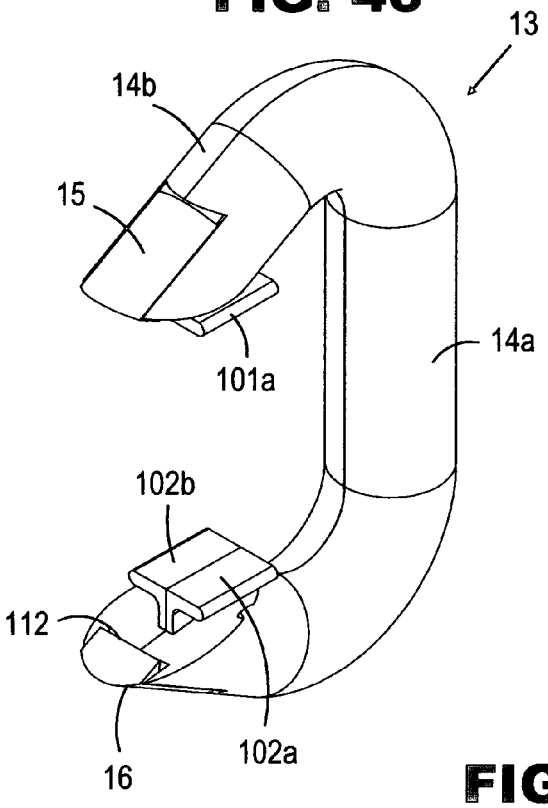
FIG. 46 is a front perspective view of the optional rear handle.
Figure 47:
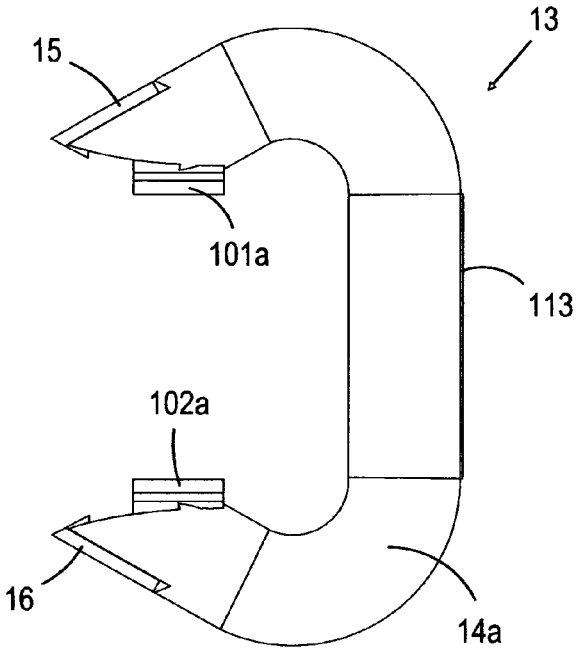
FIG. 47 is a side elevation view of the optional rear handle.
Figure 48:
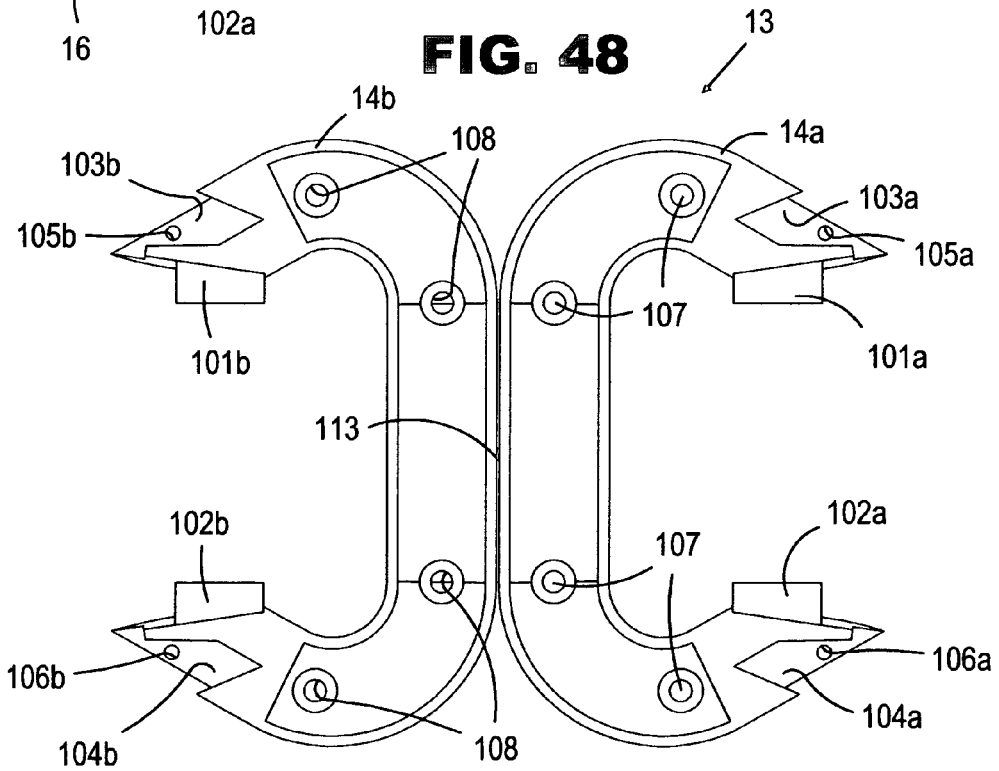
FIG. 48 is a side elevation view of the optional rear handle in the unfolded position.
Figure 49:
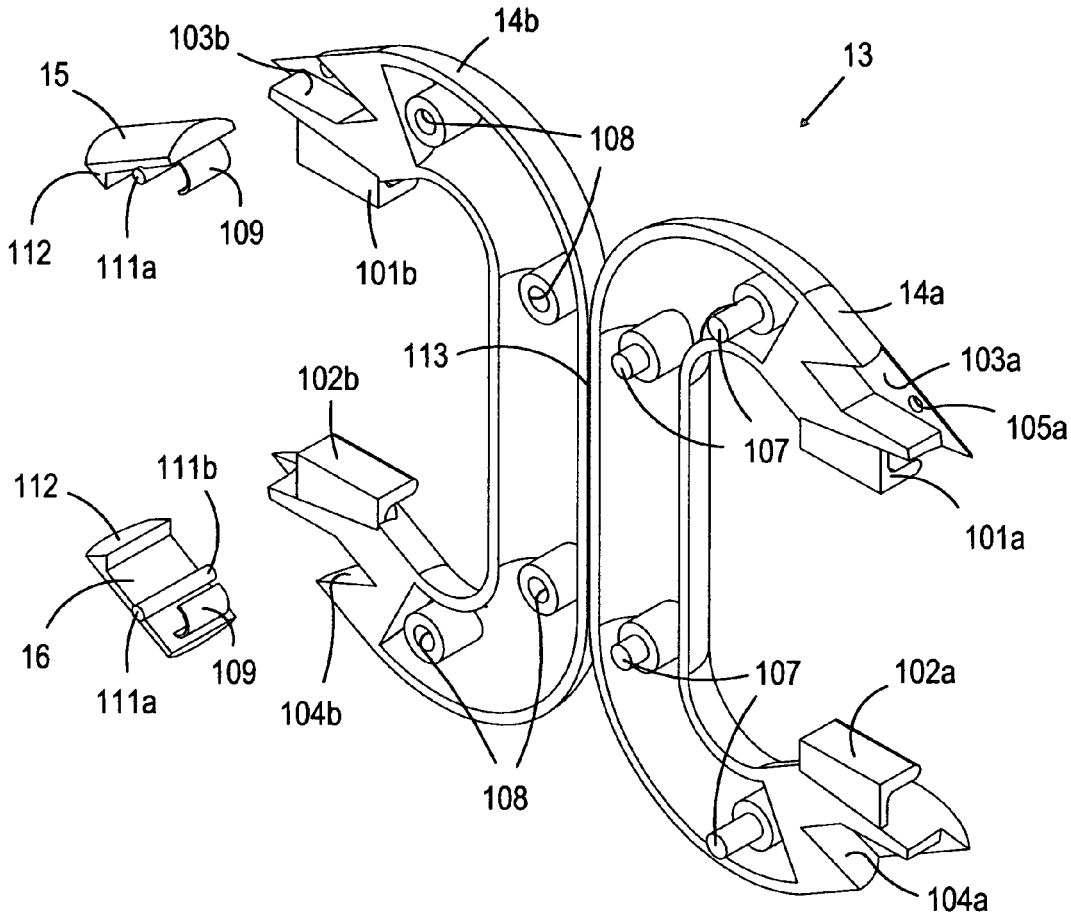
FIG. 49 is a perspective view of the optional rear handle in the unfolded position with the securing buttons separated.
Figure 50:
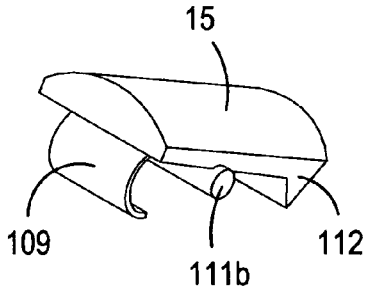
FIG. 50 is a rear perspective view of the securing button of the optional rear handle.

As voltage is applied to the motor (35), it rotates the gear (36) on rotational axis (38) in the direction indicated by arrow (39) (shown in FIG. 18) and creates an opposite rotational motion, indicated by arrow (41) on rotational axis (40), in transfer gears (32, 31) and further creates a rotational motion indicated by arrow (43) on rotational axis (42) in gear (30) thereby rotating the actuator shaft (25) and causing the upper link member actuator (28) and the lower link member actuator (29) to advance towards each other and force the scissor-type mechanism (24) to push the pusher plate (23), through opening (21) of cartridge cradle (2) (shown in FIG. 39-42), towards the piston (79) of the cartridge (78) and force the piston (79) to extrude the caulk, adhesive or other viscous material from the cartridge (78) through the nozzle (77) (as shown in FIG. 44, 45).

To stop the extrusion process, the operator's thumb actuates the rheostatic extrusion speed regulator, Forward-On, Off, Reverse-On switch (3) to the Off position (middle position) and cuts off electricity to the motor (35) thereby stopping the extrusion process. In order to return the scissor-type mechanism (24) to its fully retracted position (shown in FIG. 44), the operator's thumb actuates the rheostatic extrusion speed regulator, Forward-On, Off, Reverse-On switch (3) to the Reverse-On position in direction indicated by arrow (3*b*), and holds it until the Cut-Off switch (45) is activated, thereby cutting off electricity to the motor (35) when the scissor-type mechanism (24) is fully retracted.

Figure 51:
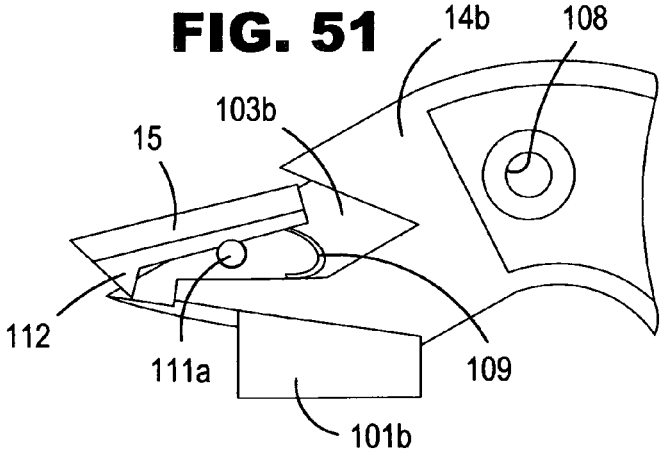
FIG. 51 is a fragmentary side elevation view of the securing button in the depressed position of the optional rear handle.
Figure 52:
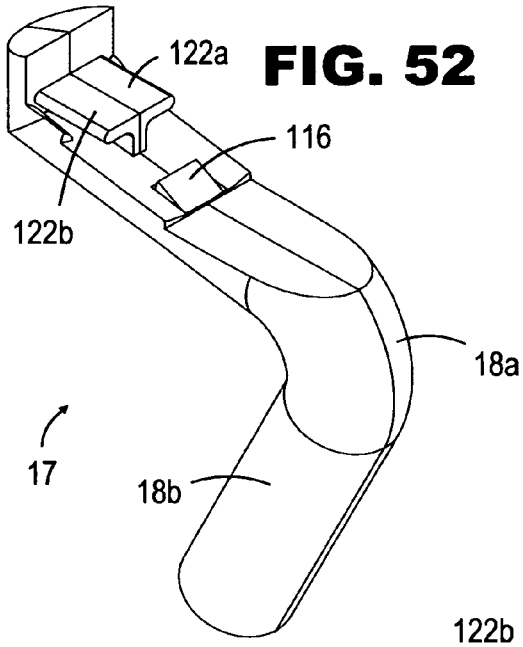
FIG. 52 is a front perspective view of the optional gun-type handle.
Figure 53:
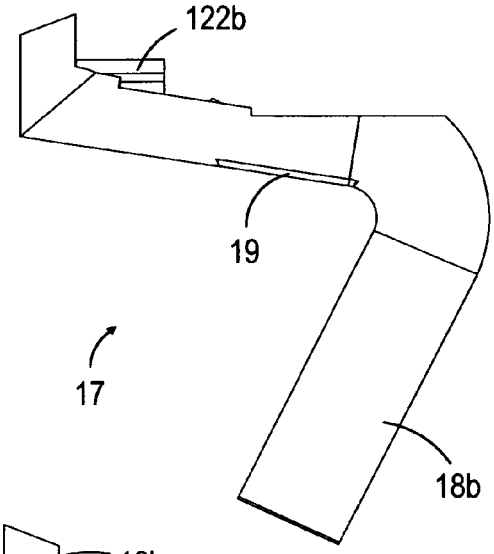
FIG. 53 is a side elevation view of the optional gun-type handle.
Figure 54:
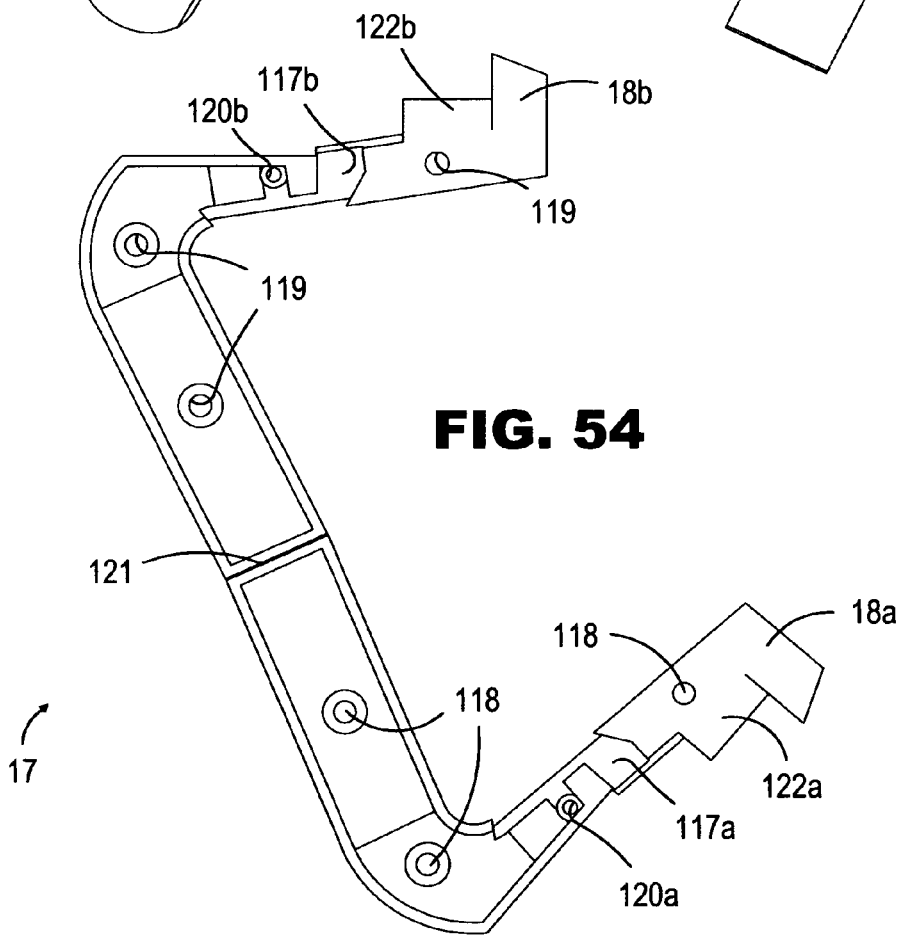
FIG. 54 is a side elevation view of the optional gun-type handle in the unfolded position.
Figure 55:
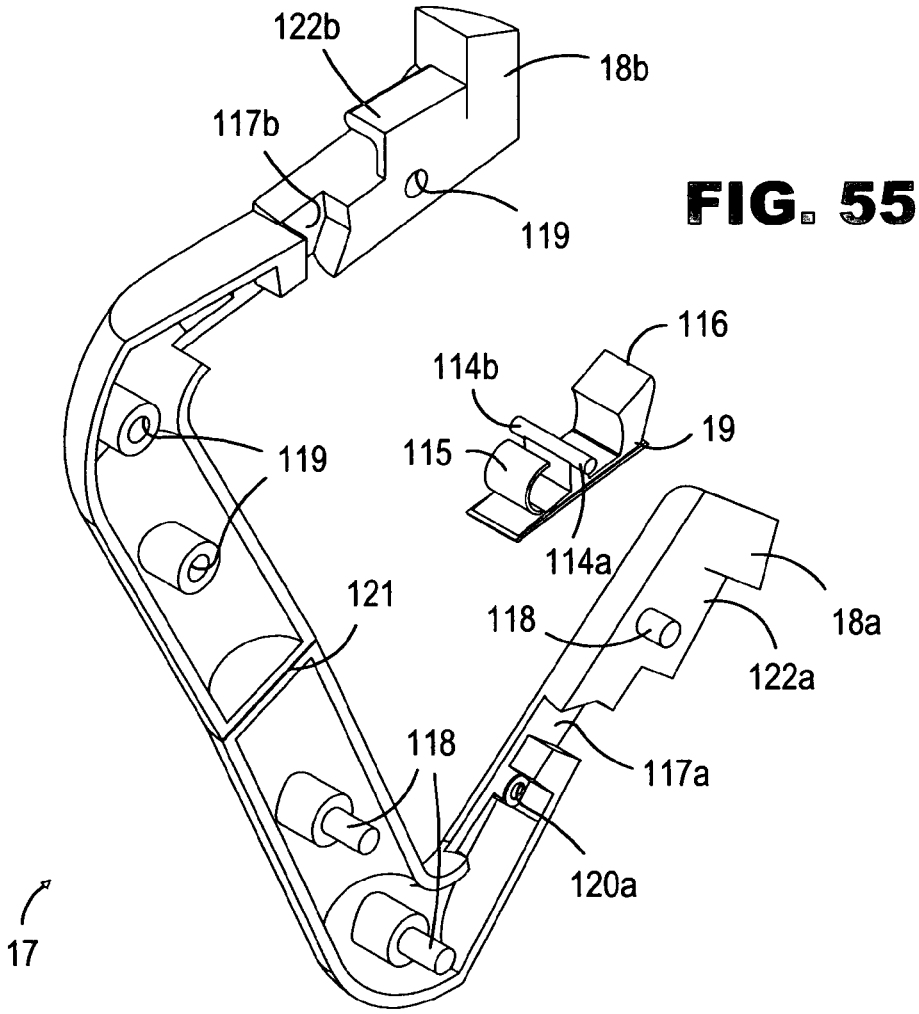
FIG. 55 is a front perspective view of the optional gun-type handle in the unfolded position with the securing button separated.

The optional attachable, detachable rear handle (13) (shown in FIG. 7-12, 46-51), preferably made of plastic (but composition is not limited to plastic), formed from one piece, foldable where the two halves (14*a*, 14*b*) are joined at the middle (113). The two halves (14*a*, 14*b*) are secured to each other via a plurality of pins (107) secured into a plurality of recesses (108). Both halves (14*a*, 14*b*) have two guide members (101*a*, 101*b*, 102*a*, 102*b*) respectively, formed thereon. Opening (9) consists of recesses (9*a*, 9*b*) formed into clamshell (4*a*, 4*b*) respectively (shown in FIG. 27-34). And opening (10) consists of recesses (10*a*, 10*b*) formed into clamshell (4*a*, 4*b*) respectively (shown in FIG. 27-34). Recess (7) consists of recesses (7*a*, 7*b*) formed into clamshell (4*a*, 4*b*) respectively (shown in FIG. 27-34). And recess (8) consists of recesses (8*a*, 8*b*) formed into clamshell (4*a*, 4*b*) respectively (shown in FIG. 27-34). In the direction indicated by arrow (3*a*), the guide members (101*a*, 101*b*, 102*a*, 102*b*) slide into openings (9, 10) respectively and are secured into recesses (7, 8) by hooks (112) formed onto buttons (15, 16). The buttons (15, 16) have resilient springs (109) formed thereon, to securely engage the hooks (112) into recesses (7, 8), and two pivoting pins (111*a*, 111*b*) formed thereon. The buttons (15, 16) are situated in recess (103*a*, 103*b*, 104*a*, 104*b*) respectively, and the pins (111*a*, 111*b*) are pivotally situated in openings (105*a*, 105*b*, 106*a*, 106*b*) respectively, formed into the two halves (14*a*, 14*b*) respectively. If the operator desires to remove the rear handle (13), the operator with fingers pressing down on buttons (15, 16) (as shown in FIG. 51) disengages hooks (112) from recesses (7, 8) and slidably removes the handle (13) in the direction indicated by arrow (3*b*).

Figure 56:
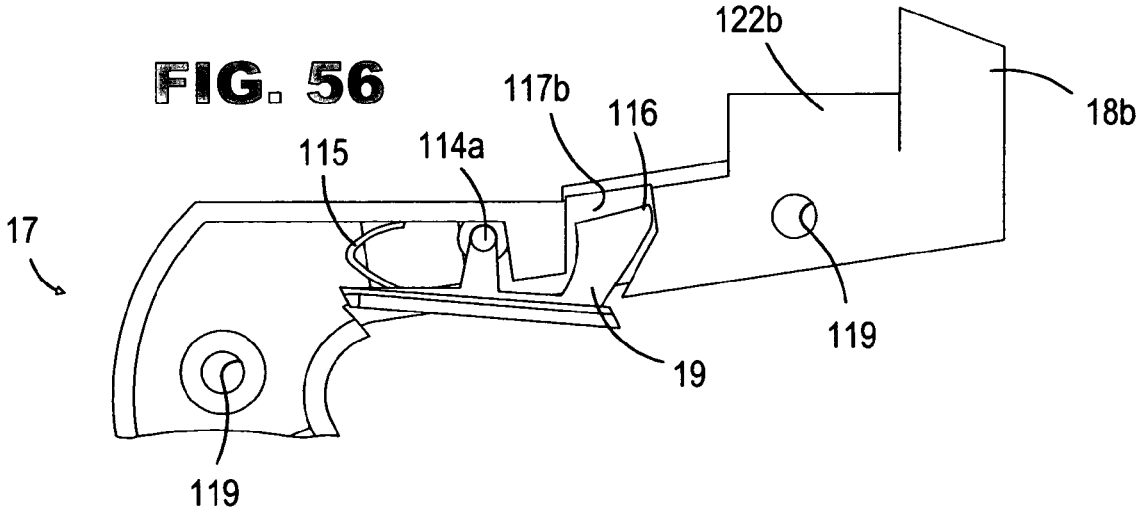
FIG. 56 is a fragmentary side elevation view of the optional gun-type handle in the unfolded position with the securing button in the depressed position.

The optional attachable, detachable gun-type handle (17) (shown in FIG. 13-17, 52-56), preferably made of plastic (but composition is not limited to plastic), formed from one piece, foldable where the two halves (18*a*, 18*b*) are joined at the middle (121). The two halves (18*a*, 18*b*) are secured to each other via a plurality of pins (118) secured into a plurality of recesses (119). Both halves (18*a*, 18*b*) have a guide member (122*a*, 122*b*) respectively, formed thereon. In the direction indicated by arrow (3*a*), the guide members (122*a*, 122*b*) slide into opening (10) and are secured into recess (8) by hook (116) formed onto button (19). The button (19) has a resilient spring (115) formed thereon, to securely engage the hook (116) into recess (8), and two pivoting pins (114*a*, 114*b*) formed thereon. The button (19) is situated in recesses (117*a*, 117*b*), and the pins (114*a*, 114*b*) are pivotally situated in openings (120*a*, 120*b*) formed into the two halves (18*a*, 18*b*) respectively. If the operator desires to remove the gun-type handle (17), the operator with finger pressing down on button (19) (as shown in FIG. 56) disengages hook (116) from recess (8) and slidably removes the handle (17) in the direction indicated by arrow (3*b*).

Thus there has been described a novel compact powered caulking gun that will hopefully improve the dispensing of caulk, adhesive or other viscous materials.

I claim:

1. A compact powered dispensing apparatus for the purpose of dispensing caulk, adhesive and other viscous materials, comprising:

a body consisting of two clamshells, with a plurality of electrical contacts incorporated into one of the clamshells;

a removable cartridge cradle with a three position, rheostatic extrusion speed regulator, forward-on, off, reverse-on switch attached to said body;

said removable cartridge cradle having a plurality of embedded electrical terminals connected to a plurality of insulated electrical wires embedded and connected to said three position, rheostatic extrusion speed regulator, forward-on, off, reverse-on switch;

a motor electrically connected via said electrical contact to said three position, rheostatic extrusion speed regulator, forward-on, off, reverse-on switch;

a battery electrically connected via said electrical contact to said three position, rheostatic extrusion speed regulator, forward-on, off, reverse-on switch;

a plurality of cut-off switches electrically connected via said electrical contact to said three position, rheostatic extrusion speed regulator, forward-on, off, reverse-on switch;

said motor operatively coupled to an actuator shaft with two oppositely pitched threads thereon;

an upper link member actuator with a pitched thread formed therewithin, rotatably situated on said actuator shaft;

a lower link member actuator with a pitched thread formed therewithin, rotatably situated on said actuator shaft;

a scissor mechanism, with a pusher plate, operatively connected to said upper link member actuator and operatively connected to said lower link member actuator.

2. A compact powered caulking gun as set forth in claim 1 wherein said body has an attachable, detachable rear handle.

3. A compact powered caulking gun as set forth in claim 1 wherein said body has an attachable, detachable gun handle.

* * * * *